US009335623B2

(12) United States Patent
Pavlacky

(10) Patent No.: US 9,335,623 B2
(45) Date of Patent: May 10, 2016

(54) THERMALLY DEVELOPABLE IMAGING MATERIALS

(71) Applicant: Carestream Health, Inc., Rochester, NY (US)

(72) Inventor: Erin C. Pavlacky, Lakeland Shores, MN (US)

(73) Assignee: Carestream Health, Inc., Rochester, NY (US)

( * ) Notice: Subject to any disclaimer, the term of this patent is extended or adjusted under 35 U.S.C. 154(b) by 0 days.

(21) Appl. No.: 14/628,388

(22) Filed: Feb. 23, 2015

(65) Prior Publication Data

US 2015/0268550 A1 Sep. 24, 2015

Related U.S. Application Data

(60) Provisional application No. 61/969,422, filed on Mar. 24, 2014.

(51) Int. Cl.
*G03C 1/498* (2006.01)

(52) U.S. Cl.
CPC ..... *G03C 1/49818* (2013.01); *G03C 1/49809* (2013.01); *G03C 1/49863* (2013.01)

(58) Field of Classification Search
CPC ..... G03C 1/49818; G03C 1/49809; G03C 1/49863; G03C 1/49845
USPC ..... 430/495.1, 564, 523, 527, 616, 617, 430/627
See application file for complete search history.

(56) References Cited

U.S. PATENT DOCUMENTS

| | | | |
|---|---|---|---|
| 2,131,038 | A | 9/1938 | Brooker et al. |
| 2,444,605 | A | 7/1948 | Heimbach et al. |
| 2,489,341 | A | 11/1949 | Waller et al. |
| 2,565,418 | A | 8/1951 | Yackel |
| 2,566,263 | A | 8/1951 | Trivelli et al. |
| 2,597,915 | A | 5/1952 | Yutzy et al. |
| 2,614,928 | A | 10/1952 | Yutzy et al. |
| 2,618,556 | A | 11/1952 | Hewitson et al. |
| 2,694,716 | A | 11/1954 | Allen et al. |
| 2,839,405 | A | 6/1958 | Jones |
| 2,886,437 | A | 5/1959 | Piper |
| 3,074,809 | A | 1/1963 | Owen |
| 3,080,254 | A | 3/1963 | Grant |
| 3,220,839 | A | 11/1965 | Herz et al. |
| 3,236,652 | A | 2/1966 | Kennard et al. |
| 3,241,969 | A | 3/1966 | Hart et al. |
| 3,287,135 | A | 11/1966 | Anderson et al. |
| 3,330,663 | A | 7/1967 | Weyde et al. |
| 3,438,776 | A | 4/1969 | Yudelson |
| 3,440,049 | A | 4/1969 | Moede |
| 3,446,648 | A | 5/1969 | Workman |
| 3,457,075 | A | 7/1969 | Morgan et al. |
| 3,700,458 | A | 10/1972 | Lindholm |
| 3,785,830 | A | 1/1974 | Sullivan et al. |
| 3,832,186 | A | 8/1974 | Masuda et al. |
| 3,839,049 | A | 10/1974 | Simons |
| 3,844,797 | A | 10/1974 | Willems et al. |
| 3,847,612 | A | 11/1974 | Winslow |
| 3,951,660 | A | 4/1976 | Hagemann et al. |
| 3,985,565 | A | 10/1976 | Gabrielsen et al. |
| 4,076,539 | A | 2/1978 | Ikenoue et al. |
| 4,082,901 | A | 4/1978 | Laridon et al. |
| 4,123,274 | A | 10/1978 | Knight et al. |
| 4,123,282 | A | 10/1978 | Winslow |
| 4,220,709 | A | 9/1980 | deMauriac |
| 4,260,677 | A | 4/1981 | Winslow et al. |
| 4,504,575 | A | 3/1985 | Lee |
| 4,761,361 | A | 8/1988 | Ozaki et al. |
| 4,775,613 | A | 10/1988 | Hirai et al. |
| 5,149,620 | A | 9/1992 | Simpson et al. |
| 5,158,866 | A | 10/1992 | Simpson et al. |
| 5,175,081 | A | 12/1992 | Krepski et al. |
| 5,250,386 | A | 10/1993 | Aono et al. |
| 5,298,390 | A | 3/1994 | Sakizadeh et al. |
| 5,300,420 | A | 4/1994 | Kenney et al. |
| 5,368,979 | A | 11/1994 | Freedman et al. |
| 5,369,000 | A | 11/1994 | Sakizadeh et al. |
| 5,374,514 | A | 12/1994 | Kirk et al. |

(Continued)

FOREIGN PATENT DOCUMENTS

| | | |
|---|---|---|
| EP | 0 227 141 | 7/1987 |
| EP | 0 600 586 | 6/1994 |

(Continued)

OTHER PUBLICATIONS

International Search Report mailed Apr. 8, 2015 for International Application No. PCT/US2015/017176, 2 pages.
Frank Ruttens, "Polyvinylbutyral, More Than Just a Binder," Journal of Imaging Science and Technology, vol. 43, No. 6, Nov./Dec. 1999, pp. 535-539.
Research Disclosure, Jun. 1978, Item 17029, 7 pages.
R. P. Loveland, "Methods of Particle-Size Analysis," ASTM Symposium on Light Micropscopy, 1955, pp. 94-122.
C.E.K. Mees and T.H. James, The Theory of the Photographic Process, Third Edition, Macmillan, New York, 1966, Chapter 2, 14 pages.
Research Disclosure, Oct. 1983, Item 23419, 4 pages.
Research Disclosure, Apr. 1983, Item 22812, 4 pages.

*Primary Examiner* — Geraldina Visconti
(74) *Attorney, Agent, or Firm* — Reed L. Christiansen; Elizabeth Q. Shipsides

(57) ABSTRACT

A thermally developable material comprising a support and having thereon at least one thermally developable imaging layers comprising in reactive association at least one non-photosensitive source of reducible silver ions, at least one reducing agent for said reducible ions, at least one binder comprising vinyl butyral repeat units and vinyl alcohol repeat units, and at least one crosslinker comprising an isocyanate group, where the thermally developable material has a composition that exhibits an equivalent weight ratio of the vinyl alcohol repeat units in the at least one binder to the isocyanate groups in the at least one crosslinker of at least 75.

8 Claims, No Drawings

(56) References Cited

U.S. PATENT DOCUMENTS

| | | | |
|---|---|---|---|
| 5,382,504 | A | 1/1995 | Shor et al. |
| 5,434,043 | A | 7/1995 | Zou et al. |
| 5,460,938 | A | 10/1995 | Kirk et al. |
| 5,464,737 | A | 11/1995 | Sakizadeh et al. |
| 5,491,059 | A | 2/1996 | Whitcomb |
| 5,541,054 | A | 7/1996 | Miller et al. |
| 5,582,953 | A | 12/1996 | Uyttendaele et al. |
| 5,594,143 | A | 1/1997 | Kirk et al. |
| 5,599,647 | A | 2/1997 | Defieuw et al. |
| 5,716,772 | A | 2/1998 | Taguchi |
| 5,817,598 | A | 10/1998 | Defieuw et al. |
| 5,939,249 | A | 8/1999 | Zou |
| 6,013,420 | A | 1/2000 | Wingender et al. |
| 6,096,486 | A | 8/2000 | Emmers et al. |
| 6,143,487 | A | 11/2000 | Philip et al. |
| 6,146,822 | A | 11/2000 | Asanuma et al. |
| 6,159,667 | A | 12/2000 | Emmers et al. |
| 6,165,704 | A | 12/2000 | Miyake et al. |
| 6,171,767 | B1 | 1/2001 | Kong et al. |
| 6,190,822 | B1 | 2/2001 | Dickerson et al. |
| 6,313,065 | B1 | 11/2001 | Horsten et al. |
| 6,355,408 | B1 | 3/2002 | Whitcomb et al. |
| 6,387,608 | B2 | 5/2002 | Morita |
| 6,413,710 | B1 | 7/2002 | Shor et al. |
| 6,465,162 | B1 | 10/2002 | Kong et al. |
| 6,472,131 | B1 | 10/2002 | Whitcomb |
| 6,475,715 | B2 | 11/2002 | Hirai et al. |
| 6,599,685 | B1 | 7/2003 | Kong |
| 6,677,274 | B2 | 1/2004 | Geuens et al. |
| 6,689,548 | B2 | 2/2004 | Yamashita et al. |
| 6,713,240 | B2 | 3/2004 | Lynch et al. |
| 6,803,177 | B2 | 10/2004 | Bokhonov et al. |
| 6,841,343 | B2 | 1/2005 | Lynch et al. |
| 6,942,960 | B2 | 9/2005 | Maskasky et al. |
| 7,018,790 | B2 | 3/2006 | Kashiwagi et al. |
| 7,135,432 | B2 | 11/2006 | Whitcomb et al. |
| 7,144,694 | B2 | 12/2006 | Kashiwagi et al. |
| 7,163,782 | B2 | 1/2007 | Goto |
| 7,172,852 | B2 | 2/2007 | Geuens et al. |
| 7,211,373 | B2 | 5/2007 | Ohzeki et |
| 7,229,752 | B2 * | 6/2007 | Kuwano ..... G03C 1/49872 430/523 |
| 7,267,934 | B2 * | 9/2007 | Goto ..... G03C 1/49845 430/350 |
| 7,316,895 | B2 | 1/2008 | Teranishi et al. |
| 7,326,527 | B2 | 2/2008 | Goto et al. |
| 7,427,467 | B2 | 9/2008 | Teranishi |
| 7,445,884 | B2 | 11/2008 | Yanagisawa |
| 7,455,961 | B2 | 11/2008 | Sakuragi et al. |
| 7,462,445 | B2 | 12/2008 | Goto |
| 7,504,200 | B2 | 3/2009 | Goto et al. |
| 2003/0203323 | A1 | 10/2003 | Takiguchi et al. |
| 2004/0053173 | A1 | 3/2004 | Maskasky et al. |
| 2008/0057447 | A1 | 3/2008 | Goto |
| 2008/0057450 | A1 | 3/2008 | Ulrich et al. |
| 2008/0085482 | A1 | 4/2008 | Sakuragi et al. |
| 2008/0187875 | A1 | 8/2008 | Goto et al. |
| 2009/0042125 | A1 | 2/2009 | Goto et al. |
| 2009/0081578 | A1 | 3/2009 | Burleva et al. |

FOREIGN PATENT DOCUMENTS

| | | |
|---|---|---|
| EP | 0 640 589 | 3/1995 |
| EP | 0 803 764 | 10/1997 |
| GB | 623448 | 5/1949 |
| GB | 1 439 478 | 6/1976 |
| GB | 1 565 043 | 4/1980 |
| JP | 49-013224 | 2/1974 |
| JP | 50-017216 | 2/1975 |
| JP | 51-042529 | 4/1976 |
| JP | 2003-156814 | 5/2003 |
| JP | 2003-207870 | 7/2003 |
| WO | WO 2007/001806 | 1/2007 |

* cited by examiner

THERMALLY DEVELOPABLE IMAGING MATERIALS

CROSS REFERENCE TO RELATED APPLICATIONS

This application claims the benefit of U.S. Provisional Application No. 61/969,422, filed Mar. 24, 2014, entitled "THERMALLY DEVELOPABLE IMAGING MATERIALS," which is hereby incorporated by reference in its entirety.

BACKGROUND

U.S. Patent Application Publication No. 2008/0057450 to Ulrich et al. discloses thermally developable materials containing reducing agent combinations. PCT Publication WO 2007/001806 to Eastman Kodak discloses thermographic materials with highly polymerized binder polymer. U.S. Pat. No. 7,211,373 to Ohzeki et al. discloses photothermographic material. EP 0803764 to Fuji discloses a method for preparing a photothermographic material. U.S. Patent Application Publication No. 2003/0203323 to Takiguchi et al. discloses silver salt photothermographic dry imaging material. U.S. Pat. No. 7,172,852 to Geuens et al. discloses a thermographic recording material. Ruttens, Frank, "Polyvinyl butyral, More Than Just a Binder," *Journal of Imaging Science and Technology*, 43(6) 535-39 (1999), various properties of poly(vinyl butyral) (PVB) resins are discussed. U.S. Pat. No. 6,387,608 to Morita discloses a photothermographic material. U.S. Pat. No. 6,475,715 to Hirai et al. discloses a photothermographic material and image forming method. U.S. Pat. No. 6,689,548 to Yamashita et al. discloses silver salt photothermographic dry imaging material, an image recording method, and an image forming method. U.S. Pat. No. 7,018,790 to Kashiwagi et al. discloses a photothermographic imaging material and method for forming image. U.S. Pat. No. 7,144,694 to Kashiwagi et al. discloses a photothermographic imaging material and method for forming an image. U.S. Pat. No. 7,163,782 to Goto discloses a photothermographic imaging material. U.S. Pat. No. 7,316,895 to Teranishi et al. discloses a method for precipitating separation of photosensitive silver halide particle dispersion and silver salt photothermographic dry imaging material using thereof. U.S. Pat. No. 7,326,527 to Goto et al. discloses silver salt photothermographic dry imaging material and image forming method by use thereof. U.S. Pat. No. 7,427,467 to Teranishi discloses silver salt photothermographic dry imaging material. U.S. Pat. No. 7,445,884 to Yanagisawa discloses a photothermographic material, development method, and thermal development device thereof. U.S. Pat. No. 7,455,961 to Sakuragi et al. discloses copolymer and photothermographic material containing the same. U.S. Pat. No. 7,462,445 to Goto discloses an image forming method. U.S. Pat. No. 7,504,200 to Goto et al. discloses a photothermographic material. U.S. Patent Publication No. 2008/0057447 to Goto discloses an image forming method. U.S. Patent Publication No. 2008/0085482 to Sakuragi et al. discloses copolymer and photothermographic material containing the same. U.S. Patent Publication No. 2008/0187875 to Goto et al. discloses a photothermographic material. U.S. Patent Publication No. 2009/0042125 to Goto et al. discloses a photothermographic material.

SUMMARY

A thermally developable material is disclosed as comprising a support and having thereon at least one thermally developable imaging layers comprising in reactive association: at least one non-photosensitive source of reducible silver ions, at least one reducing agent for said reducible ions, and at least one binder comprising vinyl butyral repeat units and vinyl alcohol repeat units, and at least one crosslinker comprising an isocyanate group, where the thermally developable material has a composition that exhibits an equivalent weight ratio of the vinyl alcohol repeat units in the at least one binder to the isocyanate groups in the at least one crosslinker of at least 75.

In some embodiments, the equivalent weight ratio of the vinyl alcohol repeat units in the at least one binder to the isocyanate groups in the at least one crosslinker between about 140 and about 300. In some embodiments, the thermally developable material is a photothermographic material and further comprises a photosensitive silver halide. In some embodiments, the at least one crosslinker comprises isocyanate repeat units. In some embodiments, the at least one crosslinker comprises hexamethylene diisocyanate. In some embodiments, the at least one crosslinker comprises 1,6-hexamethylene diisocyanate. In some embodiments, the at least one crosslinker comprises a trimer of hexamethylene diisocyanate. In some embodiments, the at least one binder comprises vinyl butyral repeat units. In some embodiments, the at least one binder comprises poly(vinyl butyral).

A photothermographic material is disclosed as comprising a support, an image forming layer comprising organic silver salt grains, light-sensitive silver halide grains, a reducing agent, a binder comprising hydroxyl repeat units, a crosslinker comprising an isocyanate group, and a surface protective layer on the image forming layer, where the photothermographic material has a composition that exhibits an equivalent weight ratio of the hydroxyl repeat units in the at least one binder to the isocyanate groups in the at least one crosslinker of at least 75.

In some embodiments, the equivalent ratio of the vinyl alcohol repeat units in the at least one binder to the isocyanate groups in the at least one crosslinker between about 140 and about 300. In some embodiments, the at least one crosslinker comprises isocyanate repeat units. In some embodiments, the at least one crosslinker comprises hexamethylene diisocyanate. In some embodiments, the at least one crosslinker comprises 1,6-hexamethylene diisocyanate. In some embodiments, the at least one crosslinker comprises a trimer of hexamethylene diisocyanate.

A photothermographic material is disclosed as comprising a support and having thereon at least one thermally developable imaging layers comprising in reactive association: at least one non-photosensitive source of reducible silver ions, at least one reducing agent for said reducible ions, and at least one binder comprising at least a first binder repeat unit comprising repeat units derived from at least one vinyl alcohol repeat unit, and at least one crosslinker comprising at least a first crosslinker repeat unit comprising repeat units derived from at least one diisocyanate repeat unit, where the photothermographic material has a composition that exhibits an equivalent weight ratio of the vinyl alcohol repeat units in the at least one binder to the diisocyanate repeat units in the at least one crosslinker of at least 75.

In some embodiments, the equivalent ratio of the vinyl alcohol repeat units in the at least one binder to the isocyanate groups in the at least one crosslinker between about 140 and about 300. In some embodiments, the at least one diisocyanate repeat unit comprises a 1,6-hexamethylene diisocyanate repeat unit. In some embodiments, the crosslinker comprises poly(1,6-hexamethylene diisocyanate). In some embodiments, the crosslinker comprises a trimer of hexamethylene diisocyanate.

DESCRIPTION

All publications, patents, and patent documents referred to in this document are incorporated by reference herein in their entirety, as though individually incorporated by reference.

U.S. Provisional Application No. 61/969,422, filed Mar. 24, 2014, entitled "THERMALLY DEVELOPABLE IMAGING MATERIALS," is hereby incorporated by reference in its entirety.

Definitions

As used herein:

In the descriptions of the materials, "a" or "an" component refers to "at least one" or "one or more" of that component.

"Thermally developable materials" refers to either "photothermographic materials" or "thermographic materials."

"Photothermographic material(s)" means a dry processable integral element comprising a support and at least one photothermographic emulsion layer or a set of photothermographic emulsion layers. The photosensitive silver halide and the source of reducible silver ions may be in one layer and the other necessary components or additives may be distributed, as desired, in the same layer or in one or more adjacent coated layers. These materials may include multilayer constructions in which one or more imaging components are in different layers, but are in "reactive association," For example, one layer can include the non-photosensitive source of reducible silver ions and another layer can include the reducing composition, but the two reactive components are in reactive association with each other.

"Thermographic materials" are similarly defined except that no photosensitive silver halide catalyst is purposely added or created.

When used in photothermography, the term, "imagewise exposing" or "imagewise exposure" means that the material is imaged as a dry processable material using any exposure means that provides a latent image using electro-magnetic radiation. This includes, for example, by analog exposure where an image is formed by projection onto the photosensitive material as well as by digital exposure where the image is formed one pixel at a time such as by modulation of scanning laser radiation.

When used in thermography, the term, "imagewise exposing" or "imagewise exposure" means that the material is imaged as a dry processable material using any means that provides an image using heat. This includes, for example, by analog exposure where an image is formed by differential contact heating through a mask using a thermal blanket or infrared heat source, as well as by digital exposure where the image is formed one pixel at a time such as by modulation of thermal print-heads or by thermal heating using scanning laser radiation.

The term "emulsion layer," "imaging layer," "thermographic emulsion layer," or "photothermographic emulsion layer" means a layer of a thermographic or photothermographic material that contains the photosensitive silver halide (when used) and/or non-photosensitive source of reducible silver ions, or a reducing composition. Such layers can also contain additional components or desirable additives. These layers are on what is referred to as the "frontside" of the support.

"Photocatalyst" means a photosensitive compound such as silver halide that, upon exposure to radiation, provides a compound that is capable of acting as a catalyst for the subsequent development of the image-forming material.

"Catalytic proximity" or "reactive association" means that the reactive components are in the same layer or in adjacent layers so that they readily come into contact with each other during imaging and thermal development.

"Simultaneous coating" or "wet-on-wet" coating means that when multiple layers are coated, subsequent layers are coated onto the initially coated layer before the initially coated layer is dry. Simultaneous coating can be used to apply layers on the frontside, backside, or both sides of the support.

"Transparent" means capable of transmitting visible light or imaging radiation without appreciable scattering or absorption.

The phrases "silver salt" and "organic silver salt" refer to an organic molecule having a bond to a silver atom. Although the compounds so formed are technically silver coordination complexes or silver compounds they are also often referred to as silver salts.

"Silver Efficiency" is defined as Dmax divided by the total silver coating weight in units of $g/m^2$.

The terms "coating weight," "coat weight," and "coverage" are synonymous, and are usually expressed in weight or moles per unit area such as $g/m^2$ or $mol/m^2$.

"Ultraviolet region of the spectrum" refers to that region of the spectrum less than or equal to 400 nm (preferably from about 100 nm to about 400 nm) although parts of these ranges may be visible to the naked human eye.

"Visible region of the spectrum" refers to that region of the spectrum of from about 400 nm to about 700 nm.

"Short wavelength visible region of the spectrum" refers to that region of the spectrum of from about 400 nm to about 450 nm.

"Red region of the spectrum" refers to that region of the spectrum of from about 600 nm to about 700 nm.

"Infrared region of the spectrum" refers to that region of the spectrum of from about 700 nm to about 1400 nm.

"Non-photosensitive" means not intentionally light sensitive.

The sensitometric terms "photospeed," "speed," or "photographic speed" (also known as sensitivity), "absorbance," and "contrast" have conventional definitions known in the imaging arts. The sensitometric term "absorbance" is a synonym for optical density (OD).

In photothermographic materials, the term Dmin (lower case), which is also referred to as minimum density, is considered herein as image density achieved when the photothermographic material is thermally developed without prior exposure to radiation. The term Dmax (lower case) is the maximum image density achieved in the imaged area of a particular sample after imaging and development.

The term ΔDmin (lower case) is the change in minimum density between the initial Dmin (lower case) and final Dmin (lower case) after being subjected to a print stability test, accelerated aging test, etc. $\Delta Dmin_B$ (lower case) is the change in minimum density between the initial Dmin (lower case) and final Dmin (lower case) using a blue filter after being subjected to a print stability test. ΔD at 1.2 IOD is the change in density between the initial density and final density at 1.2 imaged optical density. $\Delta Dens_B$ (max) is the change in maximum density between the initial Dmax (lower case) and final Dmax (lower case) using a blue filter after being subjected to a print stability test. $\Delta Dmin_V$ (lower case) is the change in minimum density between the initial Drain (lower case) and final Dmin (lower case) using a visual, standard filter after being subjected to a print stability test.

The term DMIN (upper case) is the density of the nonimaged, undeveloped material. The term DMAX (upper case) is the maximum image density achievable when the photothermographic material is exposed and then thermally developed. DMAX is also known as "Saturation Density."

The term "hot-dark print stability" refers to the susceptibility of imaged and processed (photo)thermographic materials to undergo changes in such properties as Dmin, Dmax, tint, and tone during storage under hot conditions in the absence of light.

The term "light chamber print stability" refers to the susceptibility of imaged and processed (photo)thermographic materials to undergo changes in such properties as Dmin, Dmax, tint, and tone during storage in a light chamber.

Image Tone refers to a measure of the extent of yellowness of the silver image. It is the difference in the optical density measured using a blue filter, from that of the optical density measured using a visible filter, at a visible density of 2.0. Larger Image Tone values indicate a bluer image. For use in medical imaging applications, a bluer image is generally preferred.

Speed-2 ("Spd2") is Log (1/E)+4 corresponding to the density value of 1.0 above Dmin where E is the exposure in ergs/cm$^2$.

Speed-3 ("Spd3") is Log (1/E)+4 corresponding to the density value of 2.9 above Dmin in where E is the exposure in ergs/cm2.

Average Contrast-1 ("AC-1") is the absolute value of the slope of the line joining the density points at 0.6 and 2.0 above Drain.

Average Contrast-2 ("AC-2") is the absolute value of the slope of the line joining the density points at 1.0 and 14 above Dmin.

Average Contrast-3 ("AC-3") is the absolute value of the slope of the line joining the density points at 2.4 and 2.9 above Dmin.

Average Contrast-4 ("AC-4") is the absolute value of the slope of the line joining the density points at 2.8 and 3.3 above Dmin.

Tg is the glass transition temperature and can be determined by Differential Scanning calorimetry.

Copolymers (including any number of different types of repeat units, such as, for example, terpolymers) are included in the definition of polymers.

As is well understood in this art, for the chemical compounds herein described, substitution is not only tolerated, but is often advisable, and various substituents are anticipated on the compounds used in the present invention unless otherwise stated. Thus, when a compound is referred to as "having the structure" of a given formula or being a "derivative" of a compound, any substitution that does not alter the bond structure of the formula or the shown atoms within that structure is included within the formula, unless such substitution is specifically excluded by language.

Other aspects, advantages, and benefits of the present invention are apparent from the detailed description, examples, and embodiments provided in this application.

The Photocatalyst

As noted above, photothermographic materials include one or more photocatalysts in the photothermographic emulsion layer(s). Useful photocatalysts are typically photosensitive silver halides such as silver bromide, silver iodide, silver chloride, silver bromoiodide, silver chlorobromoiodide, silver chlorobromide, and others readily apparent to one skilled in the art. Mixtures of silver halides can also be used in any suitable proportion. Silver bromide and silver iodide are preferred. More preferred is silver bromoiodide in which any suitable amount of iodide is present up to almost 100% silver iodide and more likely up to about 40 mol % silver iodide. Even more preferably, the silver bromoiodide comprises at least 70 mole % (preferably at least 85 mole % and more preferably at least 90 mole %) bromide (based on total silver halide). The remainder of the halide is iodide, chloride, or chloride and iodide. Preferably the additional halide is iodide. Silver bromide and silver bromoiodide are most preferred, with the latter silver halide generally having up to 10 mole % silver iodide.

In some embodiments of aqueous-based photothermographic materials, higher amounts of iodide may be present in homogeneous photosensitive silver halide grains, and particularly from about 20 mol % up to the saturation limit of iodide as described, for example, U.S. Patent Application Publication 2004/0053173 (Maskasky et al.).

The silver halide grains may have any crystalline habit or morphology including, but not limited to, cubic, octahedral, tetrahedral, orthorhombic, rhombic, dodecahedral, other polyhedral, tabular, laminar, twinned, or platelet morphologies and may have epitaxial growth of crystals thereon. If desired, a mixture of grains with different morphologies can be employed. Silver halide grains having cubic and tabular morphology (or both) are preferred.

The silver halide grains may have a uniform ratio of halide throughout. They may also have a graded halide content, with a continuously varying ratio of, for example, silver bromide and silver iodide or they may be of the core-shell type, having a discrete core of one or more silver halides, and a discrete shell of one or more different silver halides. Core-shell silver halide grains useful in photothermographic materials and methods of preparing these materials are described in U.S. Pat. No. 5,382,504 (Shor et al.). Iridium and/or copper doped core-shell and non-core-shell grains are described in U.S. Pat. No. 5,434,043 (Zou et al.) and U.S. Pat. No. 5,939,249 (Zou). Bismuth(III)-doped high silver iodide emulsions for aqueous-based photothermographic materials are described in U.S. Pat. No. 6,942,960 (Maskasky et al.).

In some instances, it may be helpful to prepare the photosensitive silver halide grains in the presence of a hydroxytetraazaindene (such as 4-hydroxy-6-methyl-1,3,3a,7-tetraazaindene) or an N-heterocyclic compound comprising at least one mercapto group (such as 1-phenyl-5-mercaptotetrazole) as described in U.S. Pat. No. 6,413,710 (Shor et al.).

The photosensitive silver halide can be added to (or formed within) the emulsion layer(s) in any fashion as long as it is placed in catalytic proximity to the non-photosensitive source of reducible silver ions.

It is preferred that the silver halides be preformed and prepared by an ex-situ process. With this technique, one has the possibility of more precisely controlling the grain size, grain size distribution, dopant levels, and composition of the silver halide, so that one can impart more specific properties to both the silver halide grains and the resulting photothermographic material.

In some constructions, it is preferable to form the non-photosensitive source of reducible silver ions in the presence of ex-situ-prepared silver halide. In this process, the source of reducible silver ions, such as a long chain fatty acid silver carboxylate (commonly referred to as a silver "soap" or homogenate), is formed in the presence of the preformed silver halide grains. Co-precipitation of the source of reducible silver ions in the presence of silver halide provides a more intimate mixture of the two materials to provide a material often referred to as a "preformed soap." (See, e.g., U.S. Pat. No. 3,839,049 (Simons)).

In some constructions, it is preferred that preformed silver halide grains be added to and "physically mixed" with the non-photosensitive source of reducible silver ions.

Preformed silver halide emulsions can be prepared by aqueous or organic processes and can be unwashed or washed to remove soluble salts. Soluble salts can be removed by any desired procedure for example as described in U.S. Pat. No. 2,489,341 (Waller et al.), U.S. Pat. No. 2,565,418 (Yackel), U.S. Pat. No. 2,614,928 (Yutzy et al.), U.S. Pat. No. 2,618,556 (Hewitson et al.), and U.S. Pat. No. 3,241,969 (Hart et al.).

It is also effective to use an in-situ process in which a halide- or a halogen-containing compound is added to an organic silver salt to partially convert the silver of the organic silver salt to silver halide. Inorganic halides (such as zinc bromide, zinc iodide, calcium bromide, lithium bromide, lithium iodide, or mixtures thereof) or an organic halogen-containing compound (such as N-bromo-succinimide or pyridinium hydrobromide perbromide) can be used. The details of such in-situ generation of silver halide are well known and described in U.S. Pat. No. 3,457,075 (Morgan et al.).

It is particularly effective to use a mixture of both preformed and in-situ generated silver halide. The preformed silver halide is preferably present in a preformed soap.

Additional methods of preparing silver halides and organic silver salts and blending them are described in *Research Disclosure*, June 1978, item 17029, U.S. Pat. No. 3,700,458 (Lindholm), U.S. Pat. No. 4,076,539 (Ikenoue et al.), Japan Kokai 49-013224 (Fuji), 50-017216 (Fuji), and 51-042529 (Fuji).

The silver halide grains used in the imaging formulations can vary in average diameter of up to several micrometers depending on the desired use. Preferred silver halide grains for use in preformed emulsions containing silver carboxylates are cubic grains having a number average particle size of from about 0.01 to about 1.0 μm, more preferred are those having a number average particle size of from about 0.03 to about 0.1 μm. It is even more preferred that the grains have a number average particle size of 0.06 μm or less, and most preferred that they have a number average particle size of from about 0.03 to about 0.06 μm. Mixtures of grains of various average particle sizes can also be used. Preferred silver halide grains for high-speed photothermographic constructions are tabular grains having an average thickness of at least 0.02 μm and up to and including 0.10 μm, an equivalent circular diameter of at least 0.5 μm and up to and including 8 μm, and an aspect ratio of at least 5:1. More preferred are those having an average thickness of at least 0.03 μm and up to and including 0.08 μm, an equivalent circular diameter of at least 0.75 μm and up to and including 6 μm, and an aspect ratio of at least 10:1.

The average size of the photosensitive silver halide grains is expressed by the average diameter if the grains are spherical, and by the average of the diameters of equivalent circles for the projected images if the grains are cubic or in other non-spherical shapes. Representative grain sizing methods are described in *Particle Size Analysis*, ASTM Symposium on Light Microscopy, R. P. Loveland, 1955, pp. 94-122, and in C. E. K. Mees and T. H. James, *The Theory of the Photographic Process*, Third Edition, Macmillan, New York, 1966, Chapter 2. Particle size measurements may be expressed in terms of the projected areas of grains or approximations of their diameters. These will provide reasonably accurate results if the grains of interest are substantially uniform in shape.

The one or more light-sensitive silver halides are preferably present in an amount of from about 0.005 to about 0.5 mole, more preferably from about 0.01 to about 0.25 mole, and most preferably from about 0.03 to about 0.15 mole, per mole of non-photosensitive source of reducible silver ions.

Non-Photosensitive Source of Reducible Silver Ions

The non-photosensitive source of reducible silver ions may be any silver-organic compound that contains reducible silver (I) ions. Such compounds may be silver salts of silver coordinating ligands. Such a silver salt may be an organic silver salt that is comparatively stable to light and forms a silver image when heated to 50° C. or higher in the presence of a reducing agent. Mixtures of the same or different types of silver salts can be used if desired.

Suitable organic silver salts may include silver salts of organic compounds having a carboxylic acid group. Examples thereof include silver salts of aliphatic and aromatic carboxylic acids. Silver salts of long-chain aliphatic carboxylic acids are preferred. The chains typically contain 10 to 30, and preferably 15 to 28, carbon atoms. Preferred examples of the silver salts of aliphatic carboxylic acids include silver behenate, silver arachidate, silver stearate, silver oleate, silver laurate, silver caprate, silver myristate, silver palmitate, silver maleate, silver fumarate, silver tartarate, silver furoate, silver linoleate, silver butyrate, silver camphorate, and mixtures thereof. Preferably, silver behenate is used alone or in mixtures with other silver salts.

In some embodiments, a highly crystalline silver behenate can be used as part or all of the non-photosensitive sources of reducible silver ions as described in U.S. Pat. No. 6,096,486 (Emmers et al.) and U.S. Pat. No. 6,159,667 (Emmers et al.), both incorporated herein by reference in their entirety. Moreover, the silver behenate can be used in its one or more crystallographic phases (such as a mixture of phases I, II and/or III) as described in U.S. Pat. No. 6,677,274 (Geuens et al.) that is incorporated herein by reference in its entirety.

Other examples of silver salts include but are not limited to, silver salts of aromatic carboxylic acids and other carboxylic acid group-containing compounds, silver salts of aliphatic carboxylic acids containing a thioether group as described in U.S. Pat. No. 3,330,663 (Weyde et al.), silver carboxylates comprising hydrocarbon chains incorporating ether or thioether linkages, or sterically hindered substitution in the α- (on a hydrocarbon group) or ortho- (on an aromatic group) position, as described in U.S. Pat. No. 5,491,059 (Whitcomb), silver salts of aliphatic, aromatic, or heterocyclic dicarboxylic acids, silver salts of sulfonates as described in U.S. Pat. No. 4,504,575 (Lee), silver salts of sulfosuccinates as described in EP 0 227 141 A1 (Agfa), silver salts of acetylenes as described in U.S. Pat. No. 4,761,361 (Ozaki et al.) and U.S. Pat. No. 4,775,613 (Hirai et al.), silver salts of compounds containing mercapto or thione groups and derivatives thereof (such as those having a heterocyclic nucleus containing 5 or 6 atoms in the ring, at least one of which is a nitrogen atom), as described in U.S. Pat. No. 4,123,274 (Knight et al.) and U.S. Pat. No. 3,785,830 (Sullivan et al.), silver salts of mercapto or thione substituted compounds that do not contain a heterocyclic nucleus, silver salts of compounds containing an imino group (such as silver salts of benzotriazole and substituted derivatives thereof), silver salts of 1,2,4-triazoles or 1-H-tetrazoles as described in U.S. Pat. No. 4,220,709 (deMauriac), and silver salts of imidazole and substituted imidazoles as described in U.S. Pat. No. 4,260,677 (Winslow et al.).

It is also convenient to use silver half soaps that are blends of silver carboxylates and carboxylic acids each having from 10 to 30 carbon atoms.

The methods used for making silver soap emulsions are well known in the art and are disclosed in *Research Disclosure*, April 1983, item 22812, *Research Disclosure*, October 1983, item 23419, U.S. Pat. No. 3,985,565 (Gabrielsen et al.), and the references cited above.

Non-photosensitive sources of reducible silver ions can also be provided as core-shell silver salts such as those described in U.S. Pat. No. 6,355,408 (Whitcomb et al.) or as silver dimer compounds that comprise two different silver salts as described in U.S. Pat. No. 6,472,131 (Whitcomb), both of which are incorporated herein by reference in their entirety.

Still other useful sources of non-photosensitive reducible silver ions are the silver core-shell compounds comprising a primary core comprising one or more photosensitive silver halides, or one or more non-photosensitive inorganic metal salts or non-silver containing organic salts, and a shell at least partially covering the primary core, wherein the shell comprises one or more non-photosensitive silver salts, each of which silver salts comprises a organic silver coordinating ligand. Such compounds are described in U.S. Pat. No. 6,803,177 (Bokhonov et al.) that is incorporated herein by reference in its entirety.

The one or more non-photosensitive sources of reducible silver ions are preferably present in an amount of from about 5% to about 70% (more preferably, from about 10% to about 50%), based on the total dry weight of the emulsion layers. Stated another way, the amount of the sources of reducible silver ions is generally present in an amount of from about 0.001 to about 0.2 mol/$m^2$ of the thermographic material, and preferably from about 0.006 to about 0.012 mol/$m^2$ of that material.

Reducing Agents

The thermographic materials include one or more reducing agents (of the same or different types) to reduce the silver ions during imaging. Such reducing agents are well known to those skilled in the art and include, for example, aromatic di- and tri-hydroxy compounds having at least two hydroxy groups in ortho- or para-relationship on the same aromatic nucleus such as hydroquinone and substituted hydroquinones, catechols, pyrogallol, gallic acid and gallic acid esters (for example, methyl gallate, ethyl gallate, propyl gallate), and tannic acid.

Particularly preferred are catechol-type reducing agents having no more than two hydroxy groups in an ortho-relationship.

One particularly preferred class of catechol-type reducing agents are benzene compounds in which the benzene nucleus is substituted by no more than two hydroxy groups which are present in 2,3-position on the nucleus and have in the 1-position of the nucleus a substituent linked to the nucleus by means of a carbonyl group. Compounds of this type include 2,3-dihydroxy-benzoic acid and 2,3-dihydroxy-benzoic acid esters (such as methyl 2,3-dihydroxy-benzoate, and ethyl 2,3-dihydroxy-benzoate).

Another particularly preferred class of catechol-type reducing agents are benzene compounds in which the benzene nucleus is substituted by no more than two hydroxy groups which are present in 3,4-position on the nucleus and have in the 1-position of the nucleus a substituent linked to the nucleus by means of a carbonyl group. Compounds of this type include, for example, 3,4-dihydroxy-benzoic acid, 3-(3,4-dihydroxy-phenyl)-propionic acid, 3,4-dihydroxy-benzoic acid esters (such as methyl 3,4-dihydroxy-benzoate, and ethyl 3,4-dihydroxy-benzoate), 3,4-dihydroxy-benzaldehyde, and phenyl-(3,4-dihydroxyphenyl)ketone. 3,4-Dihydroxybenzonitrile is also useful. Such compounds are described, for example, in U.S. Pat. No. 5,582,953 (Uyttendaele et al.) that is incorporated herein by reference in its entirety.

Mixtures of catechol reducing agents with various substituents can be used to optimize reactivity, Dmax, Dmin, and other imaging properties of the thermographic material.

Still another particularly useful class of reducing agents are the polyhydroxy spiro-bis-indane compounds that are described in U.S. Pat. No. 3,440,049 (Moede) and U.S. Pat. No. 5,817,598 (Defieuw et al.), both of which are incorporated herein by reference in their entirety.

In some constructions, "hindered phenol reducing agents" can be used. "Hindered phenol reducing agents" are compounds that contain only one hydroxy group on a given phenyl ring and have at least one additional substituent located ortho to the hydroxy group.

One type of hindered phenol includes hindered phenols and hindered naphthols.

Another type of hindered phenol reducing agents are hindered bis-phenols. These compounds contain more than one hydroxy group each of which is located on a different phenyl ring. This type of hindered phenol includes, for example, binaphthols (that is dihydroxybinaphthyls), biphenols (that is dihydroxybiphenyls), bis(hydroxynaphthyl)methanes, bis(hydroxyphenyl)-methanes bis(hydroxyphenyl)ethers, bis(hydroxyphenyl)sulfones, and bis(hydroxyphenyl)thioethers, each of which may have additional substituents.

Preferred hindered phenol reducing agents are bis(hydroxyphenyl)-methanes such as, bis(2-hydroxy-3-t-butyl-5-methylphenyl)methane (CAO-5), 1,1'-bis(2-hydroxy-3,5-dimethylphenyl)-3,5,5-trimethylhexane (NONOX® or PERMANAX® WSO), and 1,1'-bis(2-hydroxy-3,5-dimethylphenyl)isobutane (LOWINOX® 22IB46). Mixtures of hindered phenol reducing agents can be used if desired.

Further reducing agents include certain ortho-amino-phenol, para-amino-phenol, and hydroquinone (that is, para-hydroxy-phenol) compounds described in U.S. Pat. No. 7,135,432 (Whitcomb et al.) that is incorporated herein by reference in its entirety.

The reducing agent (or mixture thereof) described herein is generally present in an amount greater than 0.1 mole per mole of silver and at 1 to 10% (dry weight) of the emulsion layer. In multilayer constructions, if the reducing agent is added to a layer other than an emulsion layer, slightly higher proportions, of from about 2 to 15 weight % may be more desirable. Any co-developers may be present generally in an amount of from about 0.001% to about 1.5% (dry weight) of the emulsion layer coating.

Stated another way, the reducing agents described herein can be present in an amount of at least 0.03 mol/mol of total silver. Preferably, they are present in an amount of from about 0.05 to about 2 mol/mol of total silver. The total amount of silver in the thermographic materials is at least 3 mmol/$m^2$ and preferably from about 6 to about 12 mmol/$m^2$.

Other Addenda

The direct thermographic materials can also contain other additives such as toners, shelf-life stabilizers, contrast enhancers, dyes or pigments, post-processing stabilizers or stabilizer precursors, thermal solvents (also known as melt formers), and other image-modifying agents as would be readily apparent to one skilled in the art.

Suitable stabilizers that can be used alone or in combination include thiazolium salts as described in U.S. Pat. No. 2,131,038 (Brooker) and U.S. Pat. No. 2,694,716 (Allen), azaindenes as described in U.S. Pat. No. 2,886,437 (Piper), triazaindolizines as described in U.S. Pat. No. 2,444,605 (Heimbach), the urazoles described in U.S. Pat. No. 3,287,135 (Anderson), sulfocatechols as described in U.S. Pat. No. 3,236,652 (Kennard), the oximes described in GB 623,448 (Eastman Kodak), polyvalent metal salts as described in U.S. Pat. No. 2,839,405 (Jones), thiuronium salts as described in U.S. Pat. No. 3,220,839 (Herz), palladium, platinum, and gold salts as described in U.S. Pat. No. 2,566,263 (Trivelli) and U.S. Pat. No. 2,597,915 (Yutzy), compounds having —$SO_2CBr_3$ groups as described in U.S. Pat. No. 5,369,000 (Sakizadeh et al.), U.S. Pat. No. 5,464,737 (Sakizadeh et al.), U.S. Pat. No. 5,594,143 (Kirk et al.), U.S. Pat. No. 5,374,514 (Kirk et al.), and U.S. Pat. No. 5,460,938 (Kirk et al.).

Stabilizer precursor compounds capable of releasing stabilizers upon application of heat during imaging can also be used, as described in U.S. Pat. No. 5,158,866 (Simpson et al.), U.S. Pat. No. 5,175,081 (Krepski et al.), U.S. Pat. No. 5,298,390 (Sakizadeh et al.), and U.S. Pat. No. 5,300,420 (Kenney et al.).

In addition, certain substituted-sulfonyl derivatives of benzo-triazoles may be used as stabilizing compounds as described in U.S. Pat. No. 6,171,767 (Kong et al.).

"Toners" or derivatives thereof that improve the image are desirable components of the thermographic materials. These compounds, when added to the imaging layer, shift the color of the image from yellowish-orange to brown-black or blue-black. Generally, one or more toners described herein are present in an amount of from about 0.01% to about 10% (more preferably from about 0.1% to about 10%), based on the total dry weight of the layer in which the toner is included. Toners may be incorporated in the thermographic emulsion layer or in an adjacent non-imaging layer.

Compounds useful as toners are described in U.S. Pat. No. 3,074,809 (Owen), U.S. Pat. No. 3,080,254 (Grant, Jr.), U.S. Pat. No. 3,446,648 (Workman), U.S. Pat. No. 3,844,797 (Willems et al.), U.S. Pat. No. 3,847,612 (Winslow), U.S. Pat. No. 3,951,660 (Hagemann et al.), U.S. Pat. No. 4,082,901 (Laridon et al.), U.S. Pat. No. 4,123,282 (Winslow), U.S. Pat. No. 5,599,647 (Defieuw et al.), and GB 1,439,478 (Afga).

Additional useful toners are substituted and unsubstituted mercaptotriazoles as described in U.S. Pat. No. 3,832,186 (Masuda et al.), U.S. Pat. No. 5,149,620 (Simpson et al.), U.S. Pat. No. 6,165,704 (Miyake et al.), U.S. Pat. No. 6,713,240 (Lynch et al.), and U.S. Pat. No. 6,841,343 (Lynch et al.), all of which are incorporated herein by reference in their entirety.

Phthalazine and phthalazine derivatives, such as those described in U.S. Pat. No. 6,146,822 (Asanuma et al.), which is incorporated herein by reference in its entirety, are particularly useful toners.

A combination of one or more hydroxyphthalic acids and one or more phthalazinone compounds can be included in the thermographic materials. Hydroxyphthalic acid compounds have a single hydroxy substituent that is in the meta position to at least one of the carboxy groups. Preferably, these compounds have a hydroxy group in the 4-position and carboxy groups in the 1- and 2-positions. The hydroxyphthalic acids can be further substituted in other positions of the benzene ring as long as the substituents do not adversely affect their intended effects in the thermographic material. Mixtures of hydroxyphthalic acids can be used if desired.

Useful phthalazinone compounds are those having sufficient solubility to completely dissolve in the formulation from which they are coated. Preferred phthalazinone compounds include 6,7-dimethoxy-1-(2H)-phthalazinone, 4-(4-pentylphenyl)-1-(2H)-phthalazinone, and 4-(4-cyclohexylphenyl)-1-(2H)-phthalazinone. Mixtures of such phthalazinone compounds can be used if desired.

This combination facilitates obtaining a stable bluish-black image after processing. In preferred embodiments, the molar ratio of phthalazinone to hydroxyphthalic acid is from about 1:1 to about 3:1. More preferably the ratio is from about 2:1 to about 3:1.

The direct thermographic materials may also include one or more thermal solvents (or melt formers). Combinations of these compounds can also be used, such as a combination of succinimide and dimethylurea. Known thermal solvents are disclosed in U.S. Pat. No. 3,438,776 (Yudelson), U.S. Pat. No. 5,250,386 (Aono et al.), U.S. Pat. No. 5,368,979 (Freedman et al.), U.S. Pat. No. 5,716,772 (Taguchi et al.), and U.S. Pat. No. 6,013,420 (Wingender).

The thermographic materials can also include one or more image stabilizing compounds that are usually incorporated in a "backside" layer. Such compounds can include phthalazinone and its derivatives, pyridazine and its derivatives, benzoxazine and benzoxazine derivatives, benzothiazine-dione and its derivatives, and quinazoline-dione and its derivatives, particularly as described in U.S. Pat. No. 6,599,685 (Kong). Other useful backside image stabilizers include anthracene compounds, coumarin compounds, benzophenone compounds, benzotriazole compounds, naphthalic acid imide compounds, pyrazoline compounds, or compounds described in U.S. Pat. No. 6,465,162 (Kong et al.) and GB 1,565,043 (Fuji Photo).

The thermographic materials may also include one or more additional polycarboxylic acids (other than the hydroxyphthalic acids noted above) and/or anhydrides thereof that are in thermal working relationship with the sources of reducible silver ions in the one or more thermographic layers. Such polycarboxylic acids can be substituted or unsubstituted aliphatic (such as glutaric acid and adipic acid) or aromatic compounds and can be present in an amount of at least 5 mol % ratio to silver. They can be used in anhydride or partially esterified form as long as two free carboxylic acids remain in the molecule. Useful polycarboxylic acids are described for example in U.S. Pat. No. 6,096,486 (Emmers et al.).

Binders

The non-photosensitive source(s) of reducible silver ions, the reducing agent(s), toners, and any other additives may be combined with one or more polyvinyl acetal binders, which may be hydrophobic in nature. Either aqueous or organic solvent-based formulations can be used to prepare the thermally developable materials.

The polyvinyl acetals are the predominant binders in the thermally developable layers, meaning that they comprise between about 50% by weight and about 100% by weight of the total binder weight, between about 50% by weight and about 90% by weight of the total binder weight, etc. Polyvinyl acetal is the generic name for the class of polymers formed by the reaction of polyvinyl alcohol with one or more aldehydes. Polyvinyl acetal is also the name for the specific member of this class formed by reaction of polyvinyl alcohol and acetaldehyde. Typically, the aldehyde is formaldehyde or an aliphatic aldehyde having 2 to 4 carbon atoms. Acetaldehyde and butyraldehyde are commonly used aldehydes and form polyvinyl acetal (the specific polymer) and polyvinyl butyral respectively. In one exemplary embodiment, the polyvinyl acetal is polyvinyl butyral, polyvinyl acetal, or mixtures thereof.

In some embodiments, the binder may comprise a polyvinyl butyral resin, such as shown below.

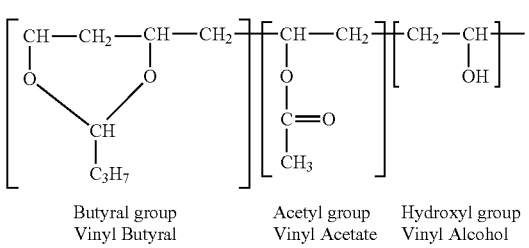

Such a binder may be prepared by a reaction of one or more polyvinyl alcohol hydroxyl groups and an aldehyde, such as butyraldehyde. In general, a polymer containing vinyl alcohol repeat units may also contain vinyl acetate repeat units, since the vinyl alcohol repeat units are generally formed from at least some of the vinyl acetate repeat units in the polymer by, for example, hydrolysis. The reaction of the hydroxyl groups with the aldehyde may be represented as:

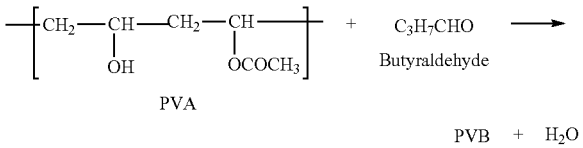

where PVA represents polyvinyl alcohol and PVB represents the resulting polyvinyl butyral resin.

Since the complete reaction of polymeric hydroxyl groups with the aldehyde may not take place, the product polymer may also comprise vinyl alcohol and vinyl acetate repeat units in addition to the vinyl butyral repeat units, as shown above. In some embodiments, the binder may comprise at least one butyral group, at least one acetyl group, and optionally, at least one hydroxyl group. In some embodiments, the binder may be a terpolymer of monomers comprising vinyl butyral, vinyl alcohol, and optionally, vinyl acetate. In some embodiments, binders may comprise copolymers of at least one first repeat unit comprising repeat units derived from at least one vinyl alcohol, at least one second repeat unit comprising repeat units derived from at least one butyraldehyde, and optionally at least one third repeat unit comprising repeat units derived from at least one vinyl acetate.

The characteristics and properties of polyvinyl butyral by itself or in a mixture to form the silver layer comprising a photosensitive catalyst may affect the silver efficiency, print stability, or accelerated aging of the film that comprises the silver layer. These properties include, but are not limited to, molecular weight, vinyl alcohol composition in terms of mol % or mole fraction, solution viscosity, total binder weight or concentration, weight fraction of the binders if more than one is being used, and glass transition temperature. These properties may be interrelated in their effect on the silver efficiency, print stability, or accelerated aging of the film.

Additional ("secondary") hydrophobic binders can be used in the thermographic layers if desired. Examples of typical secondary hydrophobic binders include low molecular weight polyvinyl acetal resins, polyvinyl chloride, polyvinyl acetate, cellulose acetate, cellulose acetate butyrate, polyolefins, polyesters, polystyrenes, polyacrylonitrile, polycarbonates, methacrylate copolymers, maleic anhydride ester copolymers, butadiene-styrene copolymers, and other materials readily apparent to one skilled in the art.

Hardeners for various binders may be present in any layer of the thermally developable material if desired. Useful hardeners including crosslinking agents, are well known and include polyisocyanate compounds as described in EP 0 600 586 B1 (3M) and U.S. Pat. No. 6,313,065 (Horsten et al.), vinyl sulfone compounds as described in U.S. Pat. No. 6,143,487 (Philip, Jr. et al.) and EP 0 640 589 A1 (Eastman Kodak), and aldehydes and various other hardeners as described in U.S. Pat. No. 6,190,822 (Dickerson et al.).

The use of polyisocyanates to crosslink the polyvinyl acetal binder permits the use of lower polymerized polyvinyl acetal binders in the thermographic emulsion layers. When such crosslinking agents are used, a polyvinyl acetal having a degree polymerization of about 500 or more can be used. Preferred isocyanates are those described below as crosslinkers for the non-light-sensitive adhesive layer. Aromatic polyisocyanates are more preferred.

The non-imaging layers of the thermally developable materials can also include one or more of the same or different hydrophobic binders as described above for the imaging layer. Binders particularly useful for various backside layers and frontside overcoats are described below.

The polymer binder(s) is used in the thermally developable layer in an amount sufficient to carry the components dispersed therein. The total binders may comprise from about 10% to about 90% by weight (more preferably at a level of from about 20% to about 70% by weight) of the total dry weight of the layer.

Support Materials

The thermally developable materials may comprise a polymeric support that is preferably a flexible, transparent film that has any desired thickness and is composed of one or more polymeric materials, depending upon their use. The supports are generally transparent (especially if the material is used as a photomask) or at least translucent, but in some instances, opaque supports may be useful. They are required to exhibit dimensional stability during thermal imaging and development and to have suitable adhesive properties with overlying layers. Useful polymeric materials for making such supports include polyesters, cellulose acetate and other cellulose esters, polyvinyl acetal, polyolefins, polycarbonates, and polystyrenes. Exemplary supports are composed of polyesters such as polyethylene terephthalate film or polycarbonates.

Opaque supports can also be used, such as dyed polymeric films and resin-coated papers that are stable to high temperatures. Support materials can contain various colorants, pigments, and dyes if desired. For example, the support can contain conventional blue dyes that differ in absorbance from colorants in the various frontside or backside layers. Support materials may be treated using conventional procedures (such as corona discharge) to improve adhesion of overlying layers, or subbing or other adhesion-promoting layers can be used.

The support thickness can be within the range of from about 2 to about 15 μm. Preferably, the support thickness is from about 4 to about 10 μm.

Isocyanate Crosslinker

In some embodiments, the silver layer, which is a light-sensitive layer, may comprise a cross-linking agent or a crosslinker that is capable of binding a binder molecule through cross linking. Without wishing to be bound by theory, it is believed that employing a cross-linking agent for the binders may improve film adhesion. It is further believed that a cross-linking agent may reduce unevenness in the developed image, fogging during storage of the film, and printout silver formation after development. Any of the various cross-linking agents may be used, including, for example, those compounds comprising an aldehyde group, an epoxy group, an ethyleneimine group, a vinylsulfone group, a sulfonic acid ester group, an acryloyl group, a carbodiimide group, or a silane group. In some embodiments, the compound may be an isocyanate compound that comprises at least one isocyanate group. In some embodiments, the compound may be an isocyanate compound that comprises two isocyanate groups.

The isocyanate compound may, for example, be an aliphatic diisocyanate, an aliphatic diisocyanate having at least one cyclic group, benzene diisocyanate, naphthalene diisocyanate, biphenyl isocyanate, diphenylmethane diisocyanate, triphenylmethane diisocyanate, a triisocyanate, or a tetraisocyanate. In some embodiments, the isocyanate compound may be a hexamethylene diisocyanate, such as a 1,6-hexamethylene diisocyanate or trimer hexamethylene diisocyanate (THDI), as shown below.

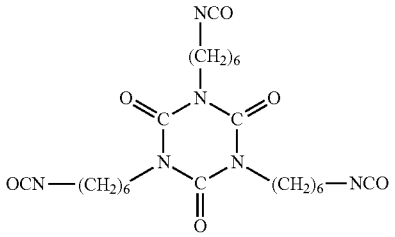

In some cases, the isocyanate compound may be poly(1,6-hexamethylene diisocyanate) and comprise 1,6-hexamethylene diisocyanate repeat units.

Without wishing to be bound by theory, it is believed that the reaction of an isocyanate group of the cross-linking agent and an alcohol group of the binder contribute to improved interlayer adhesion.

The isocyanate compound may be placed in any layer of the film. For example, it can be added to the photosensitive layer, surface protection layer, intermediate layer, anti-halation layer, under coating layer, or support. It can be added to one, two, or more layers in these layers.

The amount of the isocyanate compound may be added such that the ratio of the total mass of alcohol repeat units (e.g. vinyl alcohol) in the binder to the total mass of the isocyanate compound is at least 75, where these totals are taken across the entire reaction mixture. In some embodiments, the ratio is between about 140 and about 300. This ratio is also referred to in this application as the equivalent weight ratio of the vinyl alcohol repeat units in the binder to the isocyanate groups in the crosslinker.

Silver Efficiency

As noted above, silver efficiency is Dmax divided by the total silver coating weight in units of grams per square meter. Silver efficiency may indicate the least amount of silver (i.e. lowest silver coating weight) that can be used to prepare a suitable thermally developable material. In some embodiments, the objective may be to reduce silver coating weight for the silver layer that would allow preparation of a suitable material to reduce the use of silver and the associated costs of the raw material. In some embodiments, the silver coating weight may be between about 1.5 grams per square meter and 2.15 grams per square meter. In some embodiments, the silver coating weight may be between about 1.5 grams per square meter and 2.05 grams per square meter. In some embodiments, the silver coating weight may be between about 2.00 grams per square meter and 2.15 grams per square meter.

Print Stability

In print stability, measurements of ΔDmin are taken of imaged films under different conditions of light, humidity, and temperature for different amounts of time. As noted above, the term ΔDmin (lower case) is the change in minimum density between the initial Dmin (lower case) and final Dmin (lower case) after being subjected to a print stability test. In thermally developable materials, one goal is to minimize ΔDmin.

Accelerated Aging

In accelerated aging, measurements of ΔDmin are taken of films prior to imaging under different conditions of light, humidity, and temperature for different amounts of time. As noted above, the term ΔDmin (lower case) is the change in minimum density between the initial Dmin (lower case) and final Dmin (lower case) after being subjected to a print stability test. In thermally developable materials, one goal is to minimize ΔDmin.

Exemplary Embodiments

U.S. Provisional Application No. 61/969,422, filed Mar. 24, 2014, entitled "THERMALLY DEVELOPABLE IMAGING MATERIALS," which is hereby incorporated by reference in its entirety, disclosed the following 20 non-limiting exemplary embodiments:

A. A thermally developable material comprising a support and having thereon at least one thermally developable imaging layers comprising in reactive association:

at least one non-photosensitive source of reducible silver ions, at least one reducing agent for said reducible ions, and at least one binder comprising vinyl butyral repeat units and vinyl alcohol repeat units, and at least one crosslinker comprising an isocyanate group, wherein the thermally developable material has a composition that exhibits an equivalent weight ratio of the vinyl alcohol repeat units in the at least one binder to the isocyanate groups in the at least one crosslinker of at least 75.

B. The material of embodiment A, wherein the equivalent weight ratio of the vinyl alcohol repeat units in the at least one binder to the isocyanate groups in the at least one crosslinker between about 140 and about 300.

C. The material of either of embodiments A or B, wherein the thermally developable material is a photothermographic material and further comprises a photosensitive silver halide.

D. The material of any of embodiments A-C, wherein the at least one crosslinker comprises isocyanate repeat units.

E. The material of any of embodiments A-D, wherein the at least one crosslinker comprises hexamethylene diisocyanate.

F. The material of any of embodiments A-E, wherein the at least one crosslinker comprises 1,6-hexamethylene diisocyanate.

G. The material of any of embodiments A-F, wherein the at least one crosslinker comprises a trimer of hexamethylene diisocyanate.

H. The material of any of embodiments A-G, wherein the at least one binder comprises vinyl butyral repeat units.

J. The material of any of embodiments A-H, wherein the at least one binder comprises poly(vinyl butyral).

K. A photothermographic material comprising a support, an image forming layer comprising organic silver salt grains, light-sensitive silver halide grains, a reducing agent, a binder comprising hydroxyl repeat units, a cross-linker comprising an isocyanate group, and a surface protective layer on the image forming layer, wherein the photothermographic material has a composition that exhibits an equivalent weight ratio of the hydroxyl repeat units in the at least one binder to the isocyanate groups in the at least one crosslinker of at least 75.

L. The material of embodiment K, wherein the equivalent ratio of the vinyl alcohol repeat units in the at least one binder to the isocyanate groups in the at least one crosslinker between about 140 and about 300.

M. The material of either of embodiments K or L, wherein the at least one crosslinker comprises isocyanate repeat units.

N. The material of any of embodiments K-M, wherein the at least one crosslinker comprises hexamethylene diisocyanate.

P. The material of embodiments K-N, wherein the at least one crosslinker comprises 1,6-hexamethylene diisocyanate.

Q. The material of any of embodiments K-P, wherein the at least one crosslinker comprises a trimer of hexamethylene diisocyanate.

R. A photothermographic material comprising a support and having thereon at least one thermally developable imaging layers comprising in reactive association:

at least one non-photosensitive source of reducible silver ions, at least one reducing agent for said reducible ions, and at least one binder comprising at least a first binder repeat unit comprising repeat units derived from at least one vinyl alcohol repeat unit, and at least one crosslinker comprising at least a first crosslinker repeat unit comprising repeat units derived from at least one diisocyanate repeat unit, wherein the photothermographic material has a composition that exhibits an equivalent weight ratio of the vinyl alcohol repeat units in the at least one binder to the diisocyanate repeat units in the at least one crosslinker of at least 75.

S. The material of embodiment R, wherein the equivalent ratio of the vinyl alcohol repeat units in the at least one binder to the isocyanate groups in the at least one crosslinker between about 140 and about 300.

T. The material of either of embodiments R or S, wherein the at least one diisocyanate repeat unit comprises a 1,6-hexamethylene diisocyanate repeat unit.

U. The material of any of embodiments R-T, wherein the crosslinker comprises poly(1,6-hexamethylene diisocyanate).

V. The material of any of embodiments R-U, wherein the crosslinker comprises a trimer of hexamethylene diisocyanate.

EXAMPLES

Materials

All materials used in the following examples are readily available from standard commercial sources, such as Sigma-Aldrich Co. LLC unless otherwise specified.

B03TX is a polyvinyl butyral resin having a hydroxyl content of 16-20 wt %, maximum acetate content of 3 wt %, maximum free acid content of 0.05 wt %, maximum volatile content of 3 wt %. and weight average molecular weight of approximately 23,000 g/mol. B03TX is available from Chang Chun PetroChemical Co., Ltd. under the trade name CCP B03TX PVB.

B45H is a polyvinyl butyral resin having a non-volatile content of at least 97.5 wt %, hydroxyl group (vinyl alcohol group) content from about 18 wt % to about 21 wt %, acetyl group (vinyl acetate group) content from about 1 wt % to about 4 wt %, and weight average molecular weight of approximately 40,000 g/mol. B45H is available from Kuraray Europe GmbH, BU PVB under the trade name MOWITAL® PIOLOFORM® B 45 H PVB. B03TX has a LOWER molecular weight and a HIGHER glass transition temperature than B45H, which has a glass transition temperature of about 69 degrees Celsius.

B60HH is a polyvinyl butyral resin having a non-volatile content of at least 97.5 wt %, hydroxyl group (vinyl alcohol group) content from about 12 wt % to about 16 wt %, acetyl group (vinyl acetate group) content from about 1 wt % to about 4 wt %, and a weight average molecular weight of approximately 55,000 g/mol. B60HH is available from Kuraray Europe GmbH, BU PVB under the trade name MOWITAL® PIOLOFORM® B 60 HH PVB.

BL-1 is a polyvinyl butyral resin having a hydroxyl content of about 36 mol %, an acetyl content of no more than 3 mol %, and a butyral content of 63±3 mol %. BL-1 has a glass transition temperature of about 66° C. and a number average molecular weight of 19,000 g/mol. BL-1 is available from Sekisui Chemical Co., Ltd. under the trade name S-LEC™ BL-1.

BX-L is a polyvinyl butyral resin having a hydroxyl content of about 37 mol % and an acetyl content of no more than 3 mol %. BX-L has a glass transition temperature of about 74° C. and a number average molecular weight of 20,000 BX-L is available from Sekisui Chemical Co., Ltd. under the trade name S-LEC™ BX-L.

KS-10 is a polyvinyl butyral resin having a hydroxyl content of about 25 mol % and an acetyl content of no more than 3 mol %. KS-10 has a glass transition temperature of about 106° C. and a number average molecular weight of 17,000 g/mol. KS-10 is available from Sekisui Chemical Co., Ltd. under the trade name S-LEC™ KS-10.

BL-SHPZ is a polyvinyl butyral resin having a hydroxyl content of about 22 mol %, glass transition temperature of about 61° C., and number average molecular weight of 23,000 g/mol. BL-SHPZ is available from Sekisui Chemical Co., Ltd. under the trade name S-LEC™ BL-SHPZ.

BL-5Z is a polyvinyl butyral resin having a hydroxyl content of about 21 mol %, glass transition temperature of about 62° C., and number average molecular weight of 32,000 g/mol. BL-V is available from Sekisui Chemical Co., Ltd. under the trade name S-LEC™ BL-5Z.

BH-S is a polyvinyl butyral resin having a hydroxyl content of about 22 mol %, glass transition temperature of about 64° C., and number molecular weight of 66,000 g/mol. BH-S is available from Sekisui Chemical Co., Ltd, under the trade name S-LEC™ BH-S.

BL-1H is a polyvinyl butyral resin having a hydroxyl content of 30 mol %, glass transition temperature of 63° C., and number average molecular weight of 20,000 g/mol. BL-1H is available from Sekisui Chemical Co., Ltd. under the trade name S-LEC™ BL-1H.

KS-1 is polyvinyl butyral resin having a hydroxyl content of 25 mol %, glass transition temperature of about 107° C., and number average molecular weight of 27,000 g/mol. KS-1 is available from Sekisui Chemical Co., Ltd. under the trade name S-LEC™ KS-1.

B-05HX is a polyvinyl butyral resin having a hydroxyl content of 37 mol %, glass transition temperature of about 70° C., and number average molecular weight of 37,000 g/mol. B-05HX is available from Sekisui Chemical Co., Ltd. under the trade name S-LEC™ B-05HX.

BM-5 is a polyvinyl butyral resin having a hydroxyl content of 34 mol %, glass transition temperature of about 67° C., and number average molecular weight of 53,000 g/mol. BM-5 is available from Sekisui Chemical Co., Ltd. under the trade name S-LEC™ BM-5.

BX-35PZ is a polyvinyl butyral resin having a hydroxyl content of 24 mol %, glass transition temperature of about 90° C., and number average molecular weight of 51,000 g/mol. BX-35PZ is available from Sekisui Chemical Co., Ltd. under the trade name S-LEC™ BX-35PZ.

BL-10 is a polyvinyl butyral resin having a hydroxyl content of 28 mol %, glass transition temperature of about 59° C., butyral content of 71±3 mol %, and number average molecular weight of 15,000 g/mol. BL-10 is available from Sekisui Chemical Co., Ltd. under the trade name S-LEC™ BL-10.

BM-1 is a polyvinyl butyral resin having a hydroxyl content of 34 mol %, an acetyl content of no more than 3 mol %, butyral content of 65±3 mol %, glass transition temperature of about 67° C., and number average molecular weight of 40,000 g/mol. BM-1 is available from Sekisui Chemical Co., Ltd. under the trade name S-LEC™ BM-1.

B16H is a polyvinyl butyral resin having a non-volatile content of 97.5 wt %, polyvinyl alcohol content of about 18-21 wt % polyvinyl acetate content of about 1-4 wt %, and weight average molecular weight of approximately 15,000 g/mol. B16H is available from Kuraray Europe GmbH, BU PVB under the trade name MOWITAL® PIOLOFORM® B 16 H PVB.

BX-1 is a polyvinyl butyral resin having a hydroxyl content of about 33 mol %, no more than 3 mol % acetyl content, glass transition temperature of about 90° C., and number average molecular weight of approximately 100,000 g/mol. BX-1 is available from Sekisui Chemical Co., Ltd. under the trade name S-LEC™ BX-1.

THDI is a trimer of 1,6-hexamethylene diisocyanate.

DESMODUR® N 3300A is a solvent free polyfunctional aliphatic isocyate resin based on 1,6-hexamethylene diisocyanate (HDI). It is of the HDI trimer type. It is available from Bayer MaterialScience LLC. The average equivalent weight is 193 g/mol. The NCO content is 21.8%±0.3%. The monomeric HDI content is a maximum of 0.2%.

DESMODUR® N 3200 is a solvent free aliphatic polyisocyanate resin based on 1,6-hexamethylene diisocyanate (HDI). It is of the HDI biuret type. It is available from Bayer MaterialScience LLC. The average equivalent weight is 181 g/mol. The NCO content is 23.0%±0.5%. The monomeric HDI content is a maximum of 0.7%.

DESMODUR® N 3600 is a low viscosity solvent-free polyfunctional aliphatic polyisocyanate resin based on hexamethylene diisocyanate (HDI). It is of the HDI Poly-NCO type. It is available from Bayer MaterialScience LLC. The average equivalent weight is 183 g/mol. The NCO content is 23.0%±0.5%. The monomeric HDI content is a maximum of 0.25%.

DESMODUR® N 3800 is solvent free flexibilizing aliphatic polyisocyanate. It is of the HDI trimer type. It is available from Bayer MaterialScience LLC. The average equivalent weight is 382 g/mol. The NCO content is 11.0%±0.5%. The monomeric HDI content is a maximum of 0.3%.

DESMODUR® XP 2838 is a solvent-free aliphatic polyisocyanate. It is of the HDI+IPDI (isophorone diisocyanate) type. It is available from Bayer MaterialScience LLC. The average equivalent weight is approximately 200 g/mol. The NCO content is 21%±0.5%. The monomeric HDI content is less than 0.2%. The monomeric IPDI content is less than 0.15%. HDI and IPDI have the following structures:

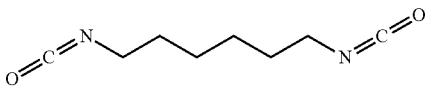

HDI

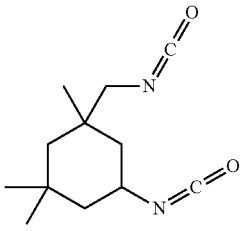

IPDI

MEK is methyl ethyl ketone (or 2-butanone).

MeOH is methanol.

BZT is benzotriazole.

PARALOID® A-21 is an acrylic polymer available from Dow Chemical Company.

CAO-5 is bis(2-hydroxy-3-t-butyl-5-methylphenyl)methane, available from Sigma-Aldrich. It has the following structure:

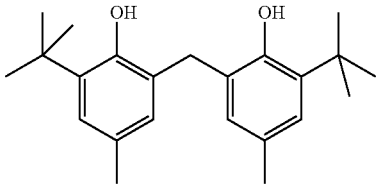

Trisphenol, available from BOC Sciences (Shirley, N.Y.), has the following structure:

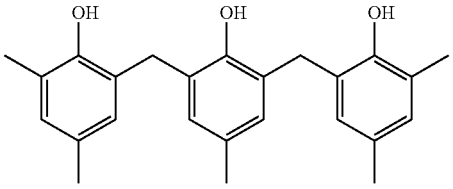

Irganox 1010 is a sterically hindered phenolic antioxidant that is available from commercial sources, such as Akrochem Corp., BASF Corp., or Chitec Tech. Corp. It has the following structure:

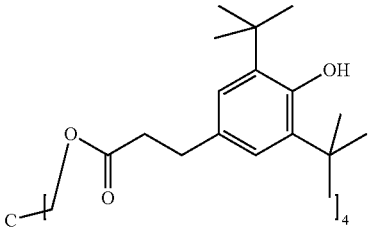

AD-1 is an IR Acutance Dye that is available from KP Synchem. It has the following structure:

(AD-1)

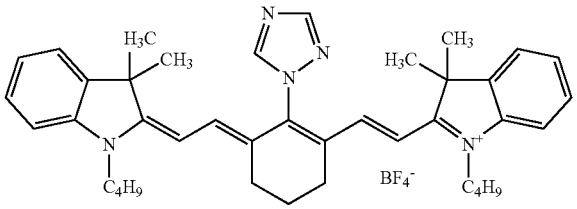

Sensitizing Dye A is described in U.S. Pat. No. 5,541,054 (Miller et al.) has the structure shown below.

(Sentizing Dye A)

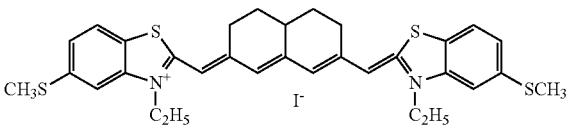

TD-1 is a tinting dye with the following structure:

(TD-1)

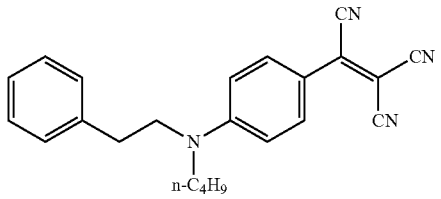

SD-1 is a support dye with the following structure:

(SD-1)

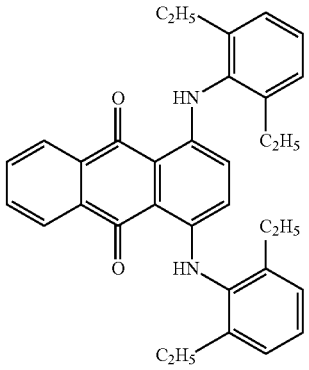

PHP is pyridinium hydrobromide perbromide.

Methods

Preparation of Photothermographic Emulsion Formulations

A preformed silver halide, silver carboxylate soap dispersion, was prepared in similar fashion to that described in U.S. Pat. No. 5,939,249, US Patent Application Publication No. 2008/0057450, and US Patent Application Publication No. 2009/0081578, which are hereby incorporated by reference herein in their entirety. The preformed silver halide, silver carboxylate soap dispersion was made by mixing preformed silver halide, silver carboxylate soap, B60HH PVB resin, and MEK. The dispersion was homogenized to form a homogenate of 28.96% solids.

The homogenate was mixed at a temperature of 67° F. and mixing rate of 400 rpm. To 168.60 parts of the homogenate, 0.238 parts of a 15% solution of PHP in 1.35 parts methanol was added with continued stirring. After 45 minutes of mixing, 0.232 parts of an 11% zinc bromide solution in 1.86 parts of methanol was added. Stirring was continued, and after 30 minutes, a solution of 0.150 parts of 2-mercapto-5-methylbenzimidazole, 0.0073 parts Sensitizing Dye A, 11.66 parts of 2-(4-chlorobenzoyl)benzoic acid, 10.81 parts of methanol, and 3.78 parts of methyl ethyl ketone was added.

After stirring for 60 minutes, the temperature was lowered to 50° F., and the mixture was divided into several samples. A selected PVB resin composition was added into each of the samples and mixed for 15 minutes at a mixing rate of between about 800 rpm and about 1200 rpm.

Solution A, Developer Solution, Solution B, and Solution C were added to each of the emulsion formulation samples and mixed at a mixing rate of 1200 rpm, 5 minutes apart. Solution D was added and mixed at a mixing rate of 11200 rpm for 20 minutes.

Solution A

| | |
|---|---|
| 2-(Tribromomethylsulphonyl)pyridine | 0.806 parts |
| Tetrachlorophthalic acid | 0.369 parts |
| 4-Methylphthalic acid | 0.717 parts |
| MEK | 16.314 parts |
| MeOH | 0.282 parts |

Developer Solution

| | |
|---|---|
| CAO-5 | 2.10 parts |
| Trisphenol | 2.67 parts |
| Irganox 1010 | 7.53 parts |

Solution B

| | |
|---|---|
| THDI | 0.658 parts |
| MEK | 0.328 parts |

Solution C

| | |
|---|---|
| Phthalazine | 1.325 parts |
| MEK | 6.290 parts |

Solution D

| | |
|---|---|
| Maleic Acid | 0.043 parts |
| MEK | 1.177 parts |

Preparation of Top Coat Formulations

A top coat formulation was prepared for each of samples by adding the materials below.

| | |
|---|---|
| Polymer Premix | 401.44 parts |
| MEK | 92.178% |
| PARALOID ® A-21 | 0.657% |
| Cellulose acetate butyrate | 7.165% |
| Ethyl 2-cyano-3-hydroxy-butanoate | 0.723 parts |
| 1,3-Bis(vinylsulfonyl)-2-propanol | 1.323 parts |
| BZT | 0.815 parts |
| THDI premix | 3.220 parts |
| MEK | 42.03 parts |
| TD-1 | 0.0184 parts |
| AD-1 | 0.434 parts |

Preparation of Photothermographic Materials

Each of the emulsion samples and a top coat formulation were simultaneously coated onto a 7 mil (about 178 μm) polyethylene terephthalate support, tinted blue with support dye SD-1. The backside of the support had been precoated with an antihalation and antistatic layer having an absorbance greater than 0.3 between 805 and 815 nm, and a resistivity of less than $10^{11}$ ohms/square. An automated dual knife coater equipped with an in-line dryer was used. Immediately after coating, samples were dried in a forced air oven at about 100° C. for about 5 minutes. The photothermographic emulsion formulation was coated to obtain a coating weight of between about 1.65 and 2.00 g of total silver/$m^2$. The overcoat formulation was coated to obtain about a dry coating weight of about 0.2 g/$ft^2$ (2.2 g/$m^2$) and an absorbance in the imaging layer of between 0.9 and 1.35 at 810 μm.

Development of Photothermographic Materials

Samples of each photothermographic material were cut into strips, exposed with a laser sensitometer at 810 nm, and thermally developed to generate continuous tone wedges with image densities varying from a minimum density (Dmin) to a maximum density (Dmax) possible for the exposure source and development conditions. Development was carried out on a 6 inch diameter (15.2 cm) heated rotating drum. The strip contacted the drum for 210 degrees of its revolution, about 11 inches (28 cm). Samples were developed at 122.5° C. for 15 seconds at a rate of 0.733 inches/sec (112 cm/min). A strip sample of each photothermographic material was scanned using a computerized densitometer equipped with both a visible filter and a blue filter having peak transmission at about 440 nm.

Measurements and Calculations of Silver Efficiency

The Dmin, Dmax. AC-1, speed-2, print stability, and accelerated aging were measured using the blue filter. Dmin, Dmax, speed-2, speed-3, and AC-1 were taken of samples developed at 122.5° C. for 15 seconds. Silver efficiency was calculated for each sample by dividing Dmax by silver coating weight in g/m$^2$. The silver coating weight of each film sample was measured by X-ray fluorescence using commonly known techniques.

Evaluation of Print Stability

Continuous tone wedge strip samples of each developed photothermographic material as prepared above, were subjected to different conditions after the film were imaged: 1) 3 hours in the dark at about 160° F. (hot-dark print stability test) and 2) 20 hours in a light chamber at 120° F. (light chamber print stability test).

Regarding the hot-dark print stability test, a set of processed samples was stacked together and tightly double-bagged in two high-density, flat-black polyethylene bags. Three strips of polyethylene terephthalate support tinted blue with support dye SD-1 were placed above and below the stack of film samples. The bagged samples were then placed in an oven and heated at 68-74° C. for 3 hours. Upon cooling to room temperature, the samples were removed from the bag and re-scanned using the same densitometer and blue filter.

Regarding the light chamber print stability test, a set of processed samples was place in a light chamber. Upon cooling to room temperature, the samples were removed from the bag and re-scanned using the same densitometer and blue filter.

Each sample subjected to different conditions was then re-scanned using the same computer densitometer and using the blue filter having a peak transmittance at about 440 nm. The changes in $Dmin_{-Blue}$ ($\Delta Dmin_{-Blue}$), $Dmax_{-Blue}$, ($\Delta Dmax_{-Blue}$ and OD-Blue ($\Delta$OD-Blue) were recorded to determine print stability.

Evaluation of Accelerated Aging

Continuous tone wedge strip samples of each developed photothermographic material as prepared above, was subjected to different conditions before the film is imaged. These conditions include variations of temperature and relative humidity for a selected duration. Each sample subjected to different conditions was then re-scanned using the same computer densitometer and using the blue filter having a peak transmittance at about 440 nm. The changes in Dmin were recorded to determine accelerated aging.

Example 1

Several samples of photothermographic material were made according to the preparations discussed in the method section. In Table I, Samples 1a-28B were prepared using varying levels of B03TX and B45H, indicated by the weight fraction of PVB that is B03TX and B45H (B03TX wt % and B45H wt %, respectively), as well as the overall mass of PVB relative to a standard amount of 45.98 g PVB (total weight fraction PVB). For example, as sample having 75 wt % of B03TX and 25 wt % of B45H at a total PVB resin weight fraction of 1 would have 34.49 grams of B03TX and 11.50 grams of B45H. In a second example, a sample having 75 wt % of B03TX and 25 wt % of B45H at a total PVB resin weight fraction of 1 would have 31.04 grams of B03TX and 10.35 grams of B45H.

As shown in Table 1, samples prepared using different amounts of THDI in the silver layer relative to the control standard. The control standard of THDI in the silver layer, which is reflected by 1 in the tables, is equivalent to 0.075 grams of THDI. In the tables, 0.5 in the THDI in the silver layer column means 0.5 times the amount of THDI in the control standard of THDI in the silver layer. 0.5 times the amount of THDI in the control standard of THDI in the silver layer is equivalent to 0.038 grams.

As shown in Table 2, silver coating weight, Dmin, Dmax, speed-2, speed-3, and AC-1 were measured and silver efficiency was calculated, Table 2B examines the additional effect of THDI concentration in the silver layer and top coat layer. As shown in Table 3, the results of the hot-dark and light chamber print stability tests were recorded for the samples shown in Table 1, respectively. $\Delta Dmin_B$ is the change in initial Dmin and final Dmin after being subjected to a print stability test. As shown in Table 4, the results of the accelerated aging tests were recorded for the samples shown in Table 1.

The following example demonstrates that: 1) the inverse relationship between each of the initial sensitometry measurements Dmin, speed-2, speed-3, and AC-1 and THDI concentration as THDI concentration is increased to the standard level or OH:NCO is decreased to the standard level, 2) improvement in silver efficiency and print stability with increasing THDI concentration to standard level or decreasing OH:NCO to standard level, and 3) negative impact on silver efficiency, print stability, and accelerated aging with increasing THDI concentration from above standard level or decreasing OH:NCO from standard level.

TABLE 1

| Sample ID | B03TX (wt %) | B45H (wt %) | Total PVB Weight Fraction | THDI in Silver Layer Relative to Control | OH:NCO Ratio of Equivalent Weights |
|---|---|---|---|---|---|
| 1a | 100 | 0 | 1.05 | 1.00 | 134 |
| 1b | 100 | 0 | 1.05 | 1.00 | 134 |
| 2a | 100 | 0 | 1.1 | 1.00 | 140 |
| 2b | 100 | 0 | 1.1 | 1.00 | 140 |
| 3a | 75 | 25 | 1.05 | 1.00 | 141 |
| 3b | 75 | 25 | 1.05 | 1.00 | 141 |
| 4a | 75 | 25 | 1.1 | 1.00 | 148 |
| 4b | 75 | 25 | 1.1 | 1.00 | 148 |
| 5a | 0 | 100 | 1.05 | 1.00 | 163 |
| 5b | 0 | 100 | 1.05 | 1.00 | 163 |
| 6a | 0 | 100 | 1.1 | 1.00 | 171 |
| 6b | 0 | 100 | 1.1 | 1.00 | 171 |
| 7a | 50 | 50 | 1 | 1.00 | 141 |
| 7b | 50 | 50 | 1 | 1.00 | 141 |
| 8a | 100 | 0 | 1.05 | 0.50 | 267 |
| 8b | 100 | 0 | 1.05 | 0.50 | 267 |
| 9a | 100 | 0 | 1.05 | 0.75 | 134 |
| 9b | 100 | 0 | 1.05 | 0.75 | 134 |
| 10a | 100 | 0 | 1.10 | 0.50 | 280 |
| 10b | 100 | 0 | 1.10 | 0.50 | 280 |
| 11a | 100 | 0 | 1.10 | 0.75 | 140 |
| 11b | 100 | 0 | 1.10 | 0.75 | 140 |
| 12a | 75 | 25 | 1.05 | 0.50 | 280 |
| 12b | 75 | 25 | 1.05 | 0.50 | 280 |
| 13a | 75 | 25 | 1.05 | 0.75 | 140 |
| 13b | 75 | 25 | 1.05 | 0.75 | 140 |

TABLE 1-continued

| Sample ID | B03TX (wt %) | B45H (wt %) | Total PVB Weight Fraction | THDI in Silver Layer Relative to Control | OH:NCO Ratio of Equivalent Weights |
|---|---|---|---|---|---|
| 14a | 75 | 25 | 1.10 | 0.50 | 295 |
| 14b | 75 | 25 | 1.10 | 0.50 | 295 |
| 15a | 75 | 25 | 1.10 | 0.75 | 148 |
| 15b | 75 | 25 | 1.10 | 0.75 | 148 |
| 16a | 0 | 100 | 1.05 | 0.50 | 326 |
| 16b | 0 | 100 | 1.05 | 0.50 | 326 |
| 17a | 0 | 100 | 1.05 | 0.75 | 163 |
| 17b | 0 | 100 | 1.05 | 0.75 | 163 |
| 18a | 0 | 100 | 1.10 | 0.50 | 341 |
| 18b | 0 | 100 | 1.10 | 0.50 | 341 |
| 19a | 0 | 100 | 1.10 | 0.75 | 171 |
| 19b | 0 | 100 | 1.10 | 0.75 | 171 |
| 20a | 50 | 50 | 1.00 | 1 | 141 |
| 20b | 50 | 50 | 1.00 | 1 | 141 |
| 21a | 50 | 50 | 1.00 | 0.5 | 293 |
| 21b | 50 | 50 | 1.00 | 0.5 | 293 |
| 22a | 50 | 50 | 1.00 | 0.75 | 195 |
| 22b | 50 | 50 | 1.00 | 0.75 | 195 |
| 23a | 50 | 50 | 1.00 | 1 | 147 |
| 23b | 50 | 50 | 1.00 | 1 | 147 |
| 24a | 50 | 50 | 1.00 | 1.25 | 117 |
| 24b | 50 | 50 | 1.00 | 1.25 | 117 |
| 25a | 50 | 50 | 1.00 | 1.5 | 98 |
| 25b | 50 | 50 | 1.00 | 1.5 | 98 |
| 26a | 50 | 50 | 1.00 | 1.75 | 84 |
| 26b | 50 | 50 | 1.00 | 1.75 | 84 |
| 27a | 50 | 50 | 1.00 | 2 | 73 |
| 27b | 50 | 50 | 1.00 | 2 | 73 |
| 28a | 50 | 50 | 1.00 | 3 | 49 |
| 28b | 50 | 50 | 1.00 | 3 | 49 |

TABLE 2

| Sample ID | Silver Coating Weight ($g/m^2$) | Silver Efficiency ($m^2/g$) | Dmin | Dmax | Speed-2 | Speed-3 | AC-1 |
|---|---|---|---|---|---|---|---|
| 1a | 1.78 | 2.12 | 0.209 | 3.77 | 1.81 | 1.42 | 5.22 |
| 1b | 1.75 | 2.17 | 0.210 | 3.80 | 1.81 | 1.44 | 5.39 |
| 2a | 1.67 | 2.2 | 0.208 | 3.68 | 1.71 | 1.26 | 4.47 |
| 2b | 1.73 | 2.2 | 0.210 | 3.81 | 1.72 | 1.32 | 4.86 |
| 3a | 1.75 | 2.17 | 0.207 | 3.79 | 1.69 | 1.23 | 4.26 |
| 3b | 1.69 | 2.37 | 0.207 | 4.00 | 1.71 | 1.3 | 4.7 |
| 4a | 1.69 | 2.19 | 0.207 | 3.70 | 1.68 | 1.2 | 4.1 |
| 4b | 1.74 | 2.19 | 0.208 | 3.82 | 1.69 | 1.22 | 4.12 |
| 5a | 1.85 | 2.02 | 0.207 | 3.75 | 1.71 | 1.14 | 3.44 |
| 5b | 1.84 | 2.13 | 0.207 | 3.92 | 1.71 | 1.18 | 3.57 |
| 6a | 1.78 | 2.17 | 0.206 | 3.86 | 1.71 | 1.18 | 3.62 |
| 6b | 1.81 | 2.13 | 0.207 | 3.86 | 1.71 | 1.17 | 3.61 |
| 7a | 1.78 | 2.08 | 0.207 | 3.70 | 1.7 | 1.17 | 3.85 |
| 7b | 1.75 | 2.06 | 0.208 | 3.61 | 1.69 | 1.12 | 3.58 |
| 8a | 1.67 | 2.12 | 0.209 | 3.55 | 1.83 | 1.40 | 5.27 |
| 8b | 1.68 | 2.22 | 0.210 | 3.73 | 1.78 | 1.35 | 4.87 |
| 9a | 1.68 | 2.21 | 0.207 | 3.71 | 1.73 | 1.32 | 4.91 |
| 9b | 1.71 | 2.17 | 0.208 | 3.70 | 1.73 | 1.33 | 5.05 |
| 10a | 1.68 | 2.12 | 0.210 | 3.56 | 1.79 | 1.37 | 5.07 |
| 10b | 1.67 | 2.16 | 0.209 | 3.60 | 1.75 | 1.33 | 4.81 |
| 11a | 1.74 | 2.09 | 0.206 | 3.64 | 1.77 | 1.39 | 5.49 |
| 11b | 1.68 | 2.13 | 0.207 | 3.58 | 1.73 | 1.36 | 5.25 |
| 12a | 1.68 | 2.15 | 0.208 | 3.62 | 1.73 | 1.25 | 4.28 |
| 12b | 1.7 | 2.24 | 0.206 | 3.81 | 1.73 | 1.26 | 4.41 |
| 13a | 1.71 | 2.22 | 0.206 | 3.79 | 1.69 | 1.23 | 4.38 |
| 13b | 1.68 | 2.2 | 0.206 | 3.70 | 1.68 | 1.21 | 4.23 |
| 14a | 1.66 | 2.25 | 0.207 | 3.73 | 1.69 | 1.22 | 4.20 |
| 14b | 1.69 | 2.21 | 0.208 | 3.73 | 1.70 | 1.24 | 4.24 |
| 15a | 1.71 | 2.22 | 0.205 | 3.79 | 1.66 | 1.21 | 4.27 |
| 15b | 1.72 | 2.21 | 0.207 | 3.79 | 1.65 | 1.18 | 4.14 |
| 16a | 1.75 | 2.17 | 0.205 | 3.80 | 1.79 | 1.25 | 3.66 |
| 16b | 1.66 | 2.23 | 0.206 | 3.70 | 1.76 | 1.18 | 3.34 |
| 17a | 1.75 | 2.1 | 0.205 | 3.68 | 1.73 | 1.17 | 3.46 |
| 17b | 1.67 | 2.13 | 0.204 | 3.56 | 1.72 | 1.10 | 3.27 |

TABLE 2-continued

| Sample ID | Silver Coating Weight ($g/m^2$) | Silver Efficiency ($m^2/g$) | Dmin | Dmax | Speed-2 | Speed-3 | AC-1 |
|---|---|---|---|---|---|---|---|
| 18a | 1.74 | 2.2 | 0.206 | 3.83 | 1.72 | 1.19 | 3.55 |
| 18b | 1.73 | 2.22 | 0.204 | 3.84 | 1.71 | 1.14 | 3.48 |
| 19a | 1.73 | 2.09 | 0.204 | 3.62 | 1.68 | 1.12 | 3.46 |
| 19b | 1.71 | 2.21 | 0.201 | 3.78 | 1.70 | 1.14 | 3.42 |
| 20a | 1.67 | 2.13 | 0.205 | 3.56 | 1.71 | 1.15 | 3.69 |
| 20b | 1.65 | 2.16 | 0.205 | 3.56 | 1.70 | 1.12 | 3.65 |
| 21a | 1.75 | 2.14 | 0.204 | 3.75 | 1.74 | 1.21 | 3.74 |
| 21b | 1.77 | 2.12 | 0.205 | 3.75 | 1.70 | 1.18 | 3.75 |
| 22a | 1.72 | 2.13 | 0.204 | 3.67 | 1.74 | 1.21 | 3.73 |
| 22b | 1.78 | 2.10 | 0.204 | 3.74 | 1.72 | 1.21 | 3.86 |
| 23a | 1.75 | 2.14 | 0.205 | 3.75 | 1.72 | 1.18 | 3.60 |
| 23b | 1.66 | 2.11 | 0.203 | 3.51 | 1.70 | 1.07 | 3.49 |
| 24a | 1.70 | 2.14 | 0.204 | 3.64 | 1.71 | 1.13 | 3.48 |
| 24b | 1.71 | 2.13 | 0.203 | 3.65 | 1.71 | 1.15 | 3.62 |
| 25a | 1.74 | 2.07 | 0.202 | 3.60 | 1.73 | 1.16 | 3.64 |
| 25b | 1.73 | 2.11 | 0.201 | 3.66 | 1.74 | 1.19 | 3.69 |
| 26a | 1.62 | 2.13 | 0.199 | 3.46 | 1.69 | 1.07 | 3.44 |
| 26b | 1.61 | 2.13 | 0.199 | 3.43 | 1.71 | 1.08 | 3.48 |
| 27a | 1.70 | 2.10 | 0.201 | 3.57 | 1.67 | 1.07 | 3.49 |
| 27b | 1.78 | 2.08 | 0.202 | 3.71 | 1.69 | 1.13 | 3.50 |
| 28a | 1.80 | 2.09 | 0.201 | 3.75 | 1.70 | 1.16 | 3.42 |
| 28b | 1.78 | 2.02 | 0.203 | 3.60 | 1.68 | 1.04 | 3.04 |

TABLE 3

| | Hot-Dark 3 hr. in dark at 160° F. | | | Light Chamber 20 hrs. in light chamber at 120° F. | |
|---|---|---|---|---|---|
| Sample ID | $\Delta Dmin_B$ | ΔD at 1.2 IOD | $\Delta Dens_B$ (max) | $\Delta Dmin_B$ | $\Delta Dmin_V$ |
| 1a | 0.033 | 0.324 | 0.35 | 0.09 | 0.10 |
| 1b | 0.030 | −0.363 | 0.04 | 0.10 | 0.10 |
| 2a | 0.027 | 0.234 | 0.28 | 0.07 | 0.08 |
| 2b | 0.029 | 0.215 | 0.27 | 0.08 | 0.09 |
| 3a | 0.025 | 0.206 | 0.24 | 0.07 | 0.08 |
| 3b | 0.027 | 0.252 | 0.29 | 0.08 | 0.07 |
| 4a | 0.024 | 0.216 | 0.26 | 0.06 | 0.06 |
| 4b | 0.024 | 0.179 | 0.23 | 0.07 | 0.07 |
| 5a | 0.081 | 0.404 | 0.40 | 0.15 | 0.14 |
| 5b | 0.074 | 0.302 | 0.32 | 0.16 | 0.15 |
| 6a | 0.059 | −0.634 | 0.07 | 0.14 | 0.12 |
| 6b | 0.074 | 0.374 | 0.38 | 0.14 | 0.13 |
| 7a | 0.028 | 0.219 | 0.24 | 0.08 | 0.07 |
| 7b | 0.027 | 0.189 | 0.21 | 0.06 | 0.06 |
| 8a | 0.038 | 0.337 | 0.36 | 0.07 | 0.06 |
| 8b | 0.034 | 0.285 | 0.30 | 0.08 | 0.07 |
| 9a | 0.031 | 0.288 | 0.34 | 0.06 | 0.05 |
| 9b | 0.031 | 0.322 | 0.36 | 0.08 | 0.07 |
| 10a | 0.033 | 0.247 | 0.29 | 0.07 | 0.05 |
| 10b | 0.031 | 0.262 | 0.31 | 0.07 | 0.06 |
| 11a | 0.034 | 0.358 | 0.40 | 0.06 | 0.06 |
| 11b | 0.033 | 0.339 | 0.40 | 0.06 | 0.06 |
| 12a | 0.028 | 0.198 | 0.22 | 0.06 | 0.05 |
| 12b | 0.032 | 0.246 | 0.27 | 0.06 | 0.05 |
| 13a | 0.029 | 0.247 | 0.28 | 0.06 | 0.05 |
| 13b | 0.030 | 0.265 | 0.28 | 0.06 | 0.04 |
| 14a | 0.027 | 0.254 | 0.28 | 0.06 | 0.05 |
| 14b | 0.029 | 0.289 | 0.33 | 0.06 | 0.04 |
| 15a | 0.026 | 0.278 | 0.32 | 0.05 | 0.04 |
| 15b | 0.026 | 0.242 | 0.29 | 0.05 | 0.04 |
| 16a | 0.089 | 0.424 | 0.43 | 0.13 | 0.10 |
| 16b | 0.082 | 0.403 | 0.40 | 0.13 | 0.11 |
| 17a | 0.082 | 0.402 | 0.40 | 0.12 | 0.10 |
| 17b | 0.080 | 0.382 | 0.38 | 0.12 | 0.09 |
| 18a | 0.073 | 0.371 | 0.37 | 0.12 | 0.10 |
| 18b | 0.077 | 0.379 | 0.38 | 0.13 | 0.11 |
| 19a | 0.071 | 0.323 | 0.33 | 0.10 | 0.08 |
| 19b | 0.069 | 0.339 | 0.34 | 0.12 | 0.08 |
| 20a | 0.024 | 0.231 | 0.25 | 0.05 | 0.04 |
| 20b | 0.025 | 0.275 | 0.29 | 0.05 | 0.03 |

TABLE 3-continued

| | Hot-Dark 3 hr. in dark at 160° F. | | | Light Chamber 20 hrs. in light chamber at 120° F. | |
|---|---|---|---|---|---|
| Sample ID | $\Delta Dmin_B$ | ΔD at 1.2 IOD | $\Delta Dens_B$ (max) | $\Delta Dmin_B$ | $\Delta Dmin_V$ |
| 21a | 0.017 | 0.134 | 0.17 | 0.07 | 0.06 |
| 21b | 0.016 | 0.155 | 0.19 | 0.07 | 0.06 |
| 22a | 0.016 | 0.168 | 0.20 | 0.07 | 0.06 |
| 22b | 0.014 | 0.175 | 0.21 | 0.06 | 0.05 |
| 23a | 0.017 | 0.173 | 0.21 | 0.07 | 0.05 |
| 23b | 0.016 | 0.161 | 0.20 | 0.05 | 0.05 |
| 24a | 0.014 | 0.162 | 0.19 | 0.06 | 0.05 |
| 24b | 0.013 | 0.180 | 0.23 | 0.06 | 0.05 |
| 25a | 0.016 | 0.199 | 0.24 | 0.06 | 0.05 |
| 25b | 0.016 | 0.207 | 0.24 | 0.05 | 0.04 |
| 26a | 0.015 | 0.226 | 0.28 | 0.05 | 0.04 |
| 26b | 0.013 | 0.227 | 0.28 | 0.05 | 0.03 |
| 27a | 0.017 | 0.196 | 0.28 | 0.05 | 0.04 |
| 27b | 0.016 | 0.175 | 0.28 | 0.05 | 0.04 |
| 28a | 0.015 | 0.189 | 0.40 | 0.05 | 0.03 |
| 28b | 0.015 | 0.160 | 0.38 | 0.05 | 0.04 |

TABLE 4A

| Sample | 5 Day 131° F., 90% RH ΔDmin | 7 Day 131° F., 90% RH ΔDmin |
|---|---|---|
| 1a | 0.032 | 0.153 |
| 1b | 0.03 | 0.147 |
| 2a | 0.027 | 0.151 |
| 2b | 0.029 | 0.172 |
| 3a | 0.024 | 0.111 |
| 3b | 0.025 | 0.117 |
| 4a | 0.022 | 0.102 |
| 4b | 0.024 | 0.125 |
| 5a | 0.02 | 0.063 |
| 5b | 0.022 | 0.068 |
| 6a | 0.02 | 0.063 |
| 6b | 0.02 | 0.065 |
| 7a | 0.022 | 0.102 |
| 7b | 0.024 | 0.112 |

TABLE 4B

| Sample | 6 Day 131° F., 90% RH ΔDmin | 9 Day 131° F., 90% RH ΔDmin |
|---|---|---|
| 8a | 0.038 | 0.134 |
| 8b | 0.039 | 0.153 |
| 9a | 0.039 | 0.107 |
| 9b | 0.04 | 0.165 |
| 10a | 0.035 | 0.142 |
| 10b | 0.039 | 0.186 |
| 11a | 0.041 | 0.173 |
| 11b | 0.031 | 0.128 |
| 12a | 0.035 | 0.162 |
| 12b | 0.033 | 0.156 |
| 13a | 0.038 | 0.147 |
| 13b | 0.037 | 0.165 |
| 14a | 0.033 | 0.149 |
| 14b | 0.03 | 0.157 |
| 15a | 0.032 | 0.158 |
| 15b | 0.035 | 0.159 |
| 16a | 0.03 | 0.086 |
| 16b | 0.029 | 0.096 |
| 17a | 0.029 | 0.096 |
| 17b | 0.031 | 0.101 |
| 18a | 0.027 | 0.086 |
| 18b | 0.027 | 0.089 |

TABLE 4B-continued

| Sample | 6 Day 131° F., 90% RH ΔDmin | 9 Day 131° F., 90% RH ΔDmin |
|---|---|---|
| 19a | 0.026 | 0.088 |
| 19b | 0.028 | 0.092 |
| 20a | 0.033 | 0.146 |
| 20b | 0.035 | 0.152 |

TABLE 4C

| Sample | 7 Day 131° F., 90% RH ΔDmin | 10 Day 131° F., 90% RH ΔDmin |
|---|---|---|
| 21a | 0.040 | 0.204 |
| 21b | 0.046 | 0.218 |
| 22a | 0.042 | 0.217 |
| 22b | 0.050 | 0.216 |
| 23a | 0.045 | 0.217 |
| 23b | 0.051 | 0.259 |
| 24a | 0.055 | 0.299 |
| 24b | 0.062 | 0.280 |
| 25a | 0.055 | 0.272 |
| 25b | 0.069 | 0.291 |
| 26a | 0.054 | 0.302 |
| 26b | 0.060 | 0.249 |
| 27a | 0.065 | 0.316 |
| 27b | 0.087 | 0.340 |
| 28a | 0.093 | 0.347 |
| 28b | 0.103 | 0.347 |

Example 2

Samples of photothermographic materials were prepared and analyzed according to the preparations discussed in the method section, except that samples contained PVB resins of similar molecular weight and different PVOH mol %, such as S-LEC™ BL-1, S-LEC™ BX-L, S-LEC™ KS-10, S-LEC™ BL-SHPZ, S-LEC™ BL-5Z, S-LEC™ BH-S, and BX-35PZ, which are available from Sekisui Chemical Co., Ltd. A control sample was prepared with a 50/50% by weight ratio of B03TX and B45H. The resins were added when preparing the photothermographic emulsion formulation. The amount of THDI in Solution B was varied, as shown in TABLE 5. All other steps remain the same. Table 5 shows the properties of the PVB resins and other process variables for preparing the photothermographic materials. Tables 6, 7, and 8A-C show silver efficiencies, print stabilities, and accelerated aging, respectively, for the samples.

These results demonstrate that there is an inverse relationship between each of silver efficiency, ΔDmin in accelerated aging, and initial sensitometry measurements Dmin, Speed-2, Speed-3, and AC-1 and THDI concentration. In other words, there is a proportional relationship between each of silver efficiency, ΔDmin in accelerated aging, and initial sensitometry measurements Dmin, Speed-2, Speed-3, and AC-1 and OH:NCO. There appears to be no significant relationship between print stability and THDI concentration or OH:NCO.

TABLE 5

| Sample | Resin | Number Average Molecular Weight | Tg (° C.) | PVOH Content (mol %) | THDI in Silver Layer relative to Control |
|---|---|---|---|---|---|
| 1a | BL-1 | 19000 | 66 | 36 | 1 |
| 1b | BL-1 | 19000 | 66 | 36 | 1 |
| 2a | BL-1 | 19000 | 66 | 36 | 2 |
| 2b | BL-1 | 19000 | 66 | 36 | 2 |
| 3a | BL-1 | 19000 | 66 | 36 | 3 |
| 3b | BL-1 | 19000 | 66 | 36 | 3 |
| 4a | BX-L | 20000 | 74 | 37 | 1 |
| 4b | BX-L | 20000 | 74 | 37 | 1 |
| 5a | BX-L | 20000 | 74 | 37 | 2 |
| 5b | BX-L | 20000 | 74 | 37 | 2 |
| 6a | BX-L | 20000 | 74 | 37 | 3 |
| 6b | BX-L | 20000 | 74 | 37 | 3 |
| 7a | KS-10 | 17000 | 106 | 25 | 1 |
| 7b | KS-10 | 17000 | 106 | 25 | 1 |
| 8a | KS-10 | 17000 | 106 | 25 | 2 |
| 8b | KS-10 | 17000 | 106 | 25 | 2 |
| 9a | KS-10 | 17000 | 106 | 25 | 3 |
| 9b | KS-10 | 17000 | 106 | 25 | 3 |
| 10a | B45H/B03TX | 32000 (wt avg) | 75 | 37-38 | 1 |
| 10b | B45H/B03TX | 32000 (wt avg) | 75 | 37-38 | 1 |
| 11a | B45H/B03TX | 32000 (wt avg) | 75 | 37-38 | 1 |
| 11b | B45H/B03TX | 32000 (wt avg) | 75 | 37-38 | 1 |
| 12a | B45H/B03TX | 32000 (wt avg) | 75 | 37-38 | 1 |
| 12b | B45H/B03TX | 32000 (wt avg) | 75 | 37-38 | 1 |
| 13a | BL-SHPZ | 23000 | 61 | 22 | 1 |
| 13b | BL-SHPZ | 23000 | 61 | 22 | 1 |
| 14a | BL-SHPZ | 23000 | 61 | 22 | 2 |
| 14b | BL-SHPZ | 23000 | 61 | 22 | 2 |
| 15a | BL-SHPZ | 23000 | 61 | 22 | 3 |
| 15b | BL-SHPZ | 23000 | 61 | 22 | 3 |
| 16a | BL-5Z | 32000 | 62 | 21 | 1 |
| 16b | BL-5Z | 32000 | 62 | 21 | 1 |
| 17a | BL-5Z | 32000 | 62 | 21 | 2 |
| 17b | BL-5Z | 32000 | 62 | 21 | 2 |
| 18a | BL-5Z | 32000 | 62 | 21 | 3 |
| 18b | BL-5Z | 32000 | 62 | 21 | 3 |
| 19a | BH-S | 66000 | 64 | 22 | 1 |
| 19b | BH-S | 66000 | 64 | 22 | 1 |
| 20a | BH-S | 66000 | 64 | 22 | 2 |
| 20b | BH-S | 66000 | 64 | 22 | 2 |
| 21a | BH-S | 66000 | 64 | 22 | 3 |
| 21b | BH-S | 66000 | 64 | 22 | 3 |
| 22a | B03TX/B45H | 32000 (wt avg) | 75 | 37-38 | 1 |
| 22b | B03TX/B45H | 32000 (wt avg) | 75 | 37-38 | 1 |
| 23a | BL-1 | 19000 | 66 | 36 | 0.50x |
| 23b | BL-1 | 19000 | 66 | 36 | 0.50x |
| 24a | BL-1 | 19000 | 66 | 36 | 0.75x |
| 24b | BL-1 | 19000 | 66 | 36 | 0.75x |
| 25a | BX-L | 20000 | 74 | 37 | 0.50x |
| 25b | BX-L | 20000 | 74 | 37 | 0.50x |
| 26a | BX-L | 20000 | 74 | 37 | 0.75x |
| 26b | BX-L | 20000 | 74 | 37 | 0.75x |
| 27a | BL-SHPZ | 23000 | 61 | 22 | 0.50x |
| 27b | BL-SHPZ | 23000 | 61 | 22 | 0.50x |
| 28a | BL-SHPZ | 23000 | 61 | 22 | 0.75x |
| 28b | BL-SHPZ | 23000 | 61 | 22 | 0.75x |
| 29a | BX-35PZ | 51000 | 90 | 24 | 0.50x |
| 29b | BX-35PZ | 51000 | 90 | 24 | 0.50x |
| 30a | BX-35PZ | 51000 | 90 | 24 | 0.75x |
| 30b | BX-35PZ | 51000 | 90 | 24 | 0.75x |
| 31a | B45H/B03TX | 32000 (wt avg) | 75 | 37-38 | 1.0x |
| 31b | B45H/B03TX | 32000 (wt avg) | 75 | 37-38 | 1.0x |

TABLE 6

| Sample ID | Silver Coating Weight g/m$^2$ | Silver Efficiency m$^2$/g | Dmin | Dmax | Speed-2 | Speed-3 | AC-1 |
|---|---|---|---|---|---|---|---|
| 1a | 1.72 | 2.23 | 0.213 | 3.84 | 1.88 | 1.38 | 4.13 |
| 1b | 1.74 | 2.17 | 0.215 | 3.78 | 1.89 | 1.37 | 4.12 |
| 2a | 1.78 | 2.18 | 0.211 | 3.88 | 1.84 | 1.35 | 4.13 |
| 2b | 1.7 | 2.16 | 0.213 | 3.68 | 1.8 | 1.27 | 3.96 |
| 3a | 1.7 | 2.1 | 0.21 | 3.57 | 1.8 | 1.26 | 3.97 |
| 3b | 1.78 | 2.08 | 0.21 | 3.7 | 1.78 | 1.3 | 4.2 |
| 4a | 1.44 | 2.2 | 0.216 | 3.78 | 1.87 | 1.37 | 4.88 |
| 4b | 1.52 | 2.16 | 0.218 | 3.65 | 1.86 | 1.36 | 4.44 |
| 5a | 1.77 | 2.24 | 0.216 | 3.8 | 1.82 | 1.35 | 4.4 |
| 5b | 1.7 | 2.2 | 0.215 | 3.86 | 1.83 | 1.4 | 4.91 |
| 6a | 1.76 | 2.16 | 0.211 | 3.84 | 1.8 | 1.38 | 4.71 |
| 6b | 1.74 | 2.16 | 0.214 | 3.73 | 1.8 | 1.35 | 4.59 |
| 7a | 1.72 | 2.13 | 0.219 | 3.87 | 1.87 | 1.49 | 5.57 |
| 7b | 1.69 | 2.17 | 0.222 | 3.93 | 1.86 | 1.47 | 5.37 |
| 8a | 1.7 | 2.14 | 0.229 | 3.89 | 1.82 | 1.44 | 5.26 |
| 8b | 1.75 | 2.13 | 0.218 | 3.73 | 1.81 | 1.39 | 5.14 |
| 9a | 1.78 | 2.12 | 0.217 | 3.69 | 1.76 | 1.34 | 4.81 |
| 9b | 1.73 | 2.12 | 0.217 | 3.63 | 1.76 | 1.31 | 4.63 |
| 10a | 1.82 | 2.14 | 0.221 | 3.76 | 1.77 | 1.23 | 3.84 |
| 10b | 1.81 | 2.16 | 0.223 | 3.82 | 1.77 | 1.25 | 3.93 |
| 11a | 1.82 | 2.15 | 0.223 | 3.80 | 1.78 | 1.25 | 3.77 |
| 11b | 1.75 | 2.13 | 0.220 | 3.78 | 1.77 | 1.24 | 3.84 |
| 12a | 1.74 | 2.14 | 0.226 | 3.79 | 1.77 | 1.25 | 4.00 |
| 12b | 1.71 | 2.12 | 0.224 | 4.03 | 1.80 | 1.35 | 4.18 |
| 13a | 1.64 | 2.08 | 0.216 | 3.42 | 1.98 | 1.31 | 4.34 |
| 13b | 1.49 | 2.19 | 0.218 | 3.26 | 1.96 | 1.06 | 3.82 |
| 14a | 1.72 | 2.08 | 0.218 | 3.58 | 1.97 | 1.36 | 4.18 |
| 14b | 1.58 | 2.12 | 0.212 | 3.35 | 1.96 | 1.05 | 5.02 |
| 15a | 1.63 | 2.1 | 0.214 | 3.42 | 1.93 | 1.23 | 4.01 |
| 15b | 1.76 | 2.15 | 0.21 | 3.78 | 1.98 | 1.55 | 5.01 |
| 16a | 1.75 | 2.07 | 0.22 | 3.61 | 1.9 | 1.32 | 3.75 |
| 16b | 1.82 | 2.1 | 0.221 | 3.82 | 1.91 | 1.38 | 3.84 |
| 17a | 1.58 | 2 | 0.219 | 3.16 | 1.84 | 1 | 3.02 |
| 17b | 1.75 | 2.03 | 0.221 | 3.56 | 1.88 | 1.26 | 3.49 |
| 18a | 1.66 | 2.02 | 0.22 | 3.35 | 1.85 | 1.13 | 3.25 |
| 18b | 1.72 | 2.06 | 0.219 | 3.54 | 1.88 | 1.26 | 3.6 |
| 19a | 1.84 | 1.98 | 0.374 | 3.64 | 1.97 | 1.29 | 3.27 |
| 19b | 1.73 | 1.91 | 0.337 | 3.3 | 1.9 | 0.8 | 2.82 |
| 20a | 2 | 1.94 | 0.383 | 3.88 | 1.95 | 1.38 | 3.43 |
| 20b | 1.8 | 1.96 | 0.354 | 3.54 | 1.94 | 1.2 | 3.11 |
| 21a | 1.94 | 1.92 | 0.361 | 3.73 | 1.94 | 1.31 | 3.26 |
| 21b | 1.83 | 1.92 | 0.347 | 3.52 | 1.94 | 1.19 | 3.08 |
| 22a | 1.75 | 2.15 | 0.219 | 3.77 | 1.78 | 1.26 | 3.91 |
| 22b | 1.67 | 2.16 | 0.217 | 3.61 | 1.76 | 1.18 | 3.57 |
| 23a | 1.87 | 2.17 | 0.202 | 4.05 | 1.86 | 1.35 | 3.73 |
| 23b | 1.86 | 2.17 | 0.202 | 4.04 | 1.82 | 1.30 | 3.66 |
| 24a | 1.90 | 2.11 | 0.199 | 4.01 | 1.79 | 1.32 | 3.98 |
| 24b | 1.94 | 2.16 | 0.201 | 4.18 | 1.79 | 1.30 | 3.91 |
| 25a | 1.88 | 2.19 | 0.202 | 4.11 | 1.82 | 1.34 | 4.04 |
| 25b | 1.80 | 2.16 | 0.201 | 3.88 | 1.81 | 1.31 | 3.93 |
| 26a | 1.92 | 2.14 | 0.202 | 4.12 | 1.80 | 1.37 | 4.76 |
| 26b | 1.89 | 2.19 | 0.201 | 4.14 | 1.79 | 1.38 | 4.55 |
| 27a | 1.98 | 2.08 | 0.213 | 4.12 | 1.94 | 1.54 | 4.99 |
| 27b | 1.88 | 2.06 | 0.212 | 3.86 | 1.89 | 1.40 | 4.26 |
| 28a | 1.94 | 2.09 | 0.209 | 4.05 | 1.89 | 1.45 | 4.53 |
| 28b | 1.96 | 2.12 | 0.213 | 4.15 | 1.87 | 1.43 | 4.34 |
| 29a | 1.77 | 2.17 | 0.205 | 3.84 | 1.81 | 1.29 | 3.89 |
| 29b | 1.86 | 2.12 | 0.207 | 3.94 | 1.82 | 1.35 | 4.22 |
| 30a | 1.89 | 2.08 | 0.206 | 3.93 | 1.79 | 1.32 | 4.11 |
| 30b | 1.86 | 2.18 | 0.206 | 4.06 | 1.84 | 1.37 | 4.18 |
| 31a | 1.69 | 2.16 | 0.201 | 3.65 | 1.77 | 1.21 | 3.66 |
| 31b | 1.77 | 2.14 | 0.202 | 3.78 | 1.76 | 1.25 | 3.93 |

TABLE 7

| | Hot-Dark 3 hr. in dark at 160° F. | | | Light Chamber 20 hrs. in light chamber at 120° F. | |
|---|---|---|---|---|---|
| Sample ID | $\Delta Dmin_B$ | ΔD at 1.2 IOD | $\Delta Dens_B$ (max) | $\Delta Dmin_B$ | $\Delta Dmin_V$ |
| 1a | 0.09 | 0.51 | 0.52 | 0.17 | 0.15 |
| 1b | 0.10 | 0.58 | 0.64 | 0.18 | 0.16 |
| 2a | 0.09 | 0.65 | 0.70 | 0.16 | 0.13 |
| 2b | 0.08 | 0.41 | 0.42 | 0.16 | 0.13 |
| 3a | 0.07 | 0.53 | 0.54 | 0.13 | 0.10 |
| 3b | 0.08 | 0.71 | 0.73 | 0.14 | 0.11 |
| 4a | 0.06 | 0.44 | 0.45 | 0.13 | 0.13 |
| 4b | 0.05 | 0.39 | 0.39 | 0.13 | 0.11 |
| 5a | 0.05 | 0.36 | 0.38 | 0.11 | 0.09 |
| 5b | 0.05 | 0.56 | 0.58 | 0.10 | 0.09 |
| 6a | 0.05 | 0.55 | 0.56 | 0.09 | 0.07 |
| 6b | 0.05 | 0.57 | 0.57 | 0.09 | 0.07 |
| 7a | 0.09 | 0.62 | 0.69 | 0.14 | 0.13 |
| 7b | 0.08 | 0.61 | 0.65 | 0.16 | 0.15 |
| 8a | 0.07 | 0.70 | 0.74 | 0.10 | 0.09 |
| 8b | 0.07 | 0.65 | 0.69 | 0.10 | 0.10 |
| 9a | 0.06 | 0.62 | 0.66 | 0.10 | 0.08 |
| 9b | 0.07 | 0.59 | 0.64 | 0.09 | 0.08 |
| 10a | 0.025 | 0.20 | 0.22 | 0.06 | 0.05 |
| 10b | 0.030 | 0.22 | 0.24 | 0.07 | 0.05 |
| 11a | 0.029 | 0.25 | 0.28 | 0.06 | 0.05 |
| 11b | 0.027 | 0.21 | 0.22 | 0.06 | 0.05 |
| 12a | 0.026 | 0.25 | 0.27 | 0.07 | 0.06 |
| 12b | 0.022 | 0.26 | 0.28 | 0.06 | 0.05 |
| 13a | 0.125 | 0.40 | 0.46 | 0.19 | 0.18 |
| 13b | 0.108 | 0.40 | 0.44 | 0.18 | 0.16 |
| 14a | 0.065 | 0.31 | 0.31 | 0.18 | 0.16 |
| 14b | 0.116 | 0.51 | 0.52 | 0.15 | 0.13 |
| 15a | 0.055 | 0.45 | 0.46 | 0.13 | 0.12 |
| 15b | 0.104 | 0.76 | 0.78 | 0.16 | 0.14 |
| 16a | 0.101 | 0.47 | 0.52 | 0.19 | 0.16 |
| 16b | 0.107 | 0.46 | 0.52 | 0.20 | 0.18 |
| 17a | 0.081 | 0.35 | 0.35 | 0.16 | 0.13 |
| 17b | 0.082 | 0.33 | 0.34 | 0.16 | 0.14 |
| 18a | 0.057 | 0.29 | 0.30 | 0.14 | 0.12 |
| 18b | 0.068 | 0.36 | 0.36 | 0.16 | 0.15 |
| 19a | 0.702 | 1.01 | 1.30 | 0.36 | 0.35 |
| 19b | 0.455 | 0.71 | 0.84 | 0.30 | 0.28 |
| 20a | 0.848 | 1.14 | 1.50 | 0.39 | 0.37 |
| 20b | 0.555 | 0.80 | 0.96 | 0.31 | 0.30 |
| 21a | 0.390 | 0.78 | 0.86 | 0.31 | 0.30 |
| 21b | 0.298 | 0.75 | 0.83 | 0.27 | 0.26 |
| 22a | 0.028 | 0.25 | 0.26 | 0.06 | 0.04 |
| 22b | 0.025 | 0.24 | 0.26 | 0.06 | 0.05 |
| 23a | 0.111 | 0.49 | 0.49 | 0.15 | 0.13 |
| 23b | 0.109 | 0.48 | 0.48 | 0.15 | 0.12 |
| 24a | 0.107 | 0.52 | 0.53 | 0.15 | 0.12 |
| 24b | 0.125 | 0.55 | 0.55 | 0.16 | 0.14 |
| 25a | 0.069 | 0.39 | 0.40 | 0.12 | 0.10 |
| 25b | 0.053 | 0.29 | 0.30 | 0.10 | 0.07 |
| 26a | 0.062 | 0.37 | 0.37 | 0.11 | 0.09 |
| 26b | 0.071 | 0.45 | 0.47 | 0.11 | 0.09 |
| 27a | 0.247 | 0.71 | 0.80 | 0.20 | 0.19 |
| 27b | 0.159 | 0.46 | 0.54 | 0.17 | 0.15 |
| 28a | 0.183 | 0.60 | 0.67 | 0.18 | 0.17 |
| 28b | 0.190 | 0.59 | 0.72 | 0.20 | 0.18 |
| 29a | 0.035 | 0.31 | 0.33 | 0.04 | 0.03 |
| 29b | 0.042 | 0.22 | 0.27 | 0.04 | 0.02 |
| 30a | 0.042 | 0.24 | 0.28 | 0.04 | 0.03 |
| 30b | 0.044 | 0.26 | 0.29 | 0.04 | 0.03 |
| 31a | 0.026 | 0.23 | 0.26 | 0.05 | 0.03 |
| 31b | 0.028 | 0.23 | 0.27 | 0.04 | 0.04 |

TABLE 8A

| Sample | 6 Day 131° F., 90% RH ΔDmin | 8 Day 131° F., 90% RH ΔDmin | 10 Day 131° F., 90% RH ΔDmin |
|---|---|---|---|
| 1a | 0.057 | 0.111 | 0.536 |
| 1b | 0.05 | 0.084 | 0.412 |
| 2a | 0.035 | 0.085 | 0.537 |
| 2b | 0.038 | 0.086 | 0.666 |
| 3a | 0.032 | 0.091 | 0.664 |
| 3b | 0.035 | 0.087 | 0.678 |
| 4a | 0.048 | 0.093 | 0.368 |
| 4b | 0.031 | 0.111 | 0.627 |
| 5a | 0.039 | 0.13 | 0.719 |
| 5b | 0.041 | 0.114 | 0.552 |
| 6a | 0.053 | 0.139 | 0.585 |
| 6b | 0.051 | 0.153 | 0.69 |
| 7a | 0.029 | 0.068 | 0.448 |
| 7b | 0.025 | 0.077 | 0.515 |
| 8a | 0.038 | 0.131 | 0.67 |
| 8b | 0.043 | 0.121 | 0.745 |
| 9a | 0.057 | 0.143 | 0.667 |
| 9b | 0.063 | 0.178 | 1.046 |
| 10a | 0.06 | 0.18 | 1.804 |
| 10b | 0.056 | 0.159 | 1.475 |
| 11a | 0.054 | 0.167 | 2.079 |
| 11b | 0.057 | 0.167 | 1.78 |
| 12a | 0.042 | 0.131 | 1.13 |
| 12b | 0.049 | 0.113 | 0.758 |

TABLE 8B

| Sample | 6 Day 131° F., 90% RH ΔDmin | 9 Day 131° F., 90% RH ΔDmin | 12 Day 131° F., 90% RH ΔDmin |
|---|---|---|---|
| 13a | 0.067 | 0.173 | 0.718 |
| 13b | 0.057 | 0.394 | 1.968 |
| 14a | 0.046 | 0.207 | 0.803 |
| 14b | 0.049 | 0.166 | 0.482 |
| 15a | 0.033 | 0.294 | 1.637 |
| 15b | 0.044 | 0.172 | 0.653 |
| 16a | 0.024 | 0.146 | 0.987 |
| 16b | 0.025 | 0.165 | 0.884 |
| 17a | 0.02 | 0.37 | 1.975 |
| 17b | 0.023 | 0.192 | 1.354 |
| 18a | 0.02 | 0.189 | 1.588 |
| 18b | 0.022 | 0.148 | 1.175 |
| 19a | −0.04 | 0.067 | 1.015 |
| 19b | −0.033 | 0.259 | 1.586 |
| 20a | −0.024 | 0.08 | 0.677 |
| 20b | −0.056 | 0.152 | 1.156 |
| 21a | −0.03 | 0.069 | 1.169 |
| 21b | −0.02 | 0.148 | 1.019 |
| 22a | 0.037 | 0.826 | 1.999 |
| 22b | 0.034 | 1.142 | 2.545 |

TABLE 8C

| Sample | 5 Day 131° F., 90% RH ΔDmin | 7 Day 131° F., 90% RH ΔDmin | 9 Day 131° F., 90% RH ΔDmin |
|---|---|---|---|
| 23a | 0.03 | 0.089 | 0.139 |
| 23b | 0.025 | 0.068 | 0.119 |
| 24a | 0.026 | 0.069 | 0.099 |
| 24b | 0.024 | 0.065 | 0.098 |
| 25a | 0.021 | 0.061 | 0.096 |
| 25b | 0.017 | 0.056 | 0.1 |
| 26a | 0.012 | 0.052 | 0.073 |
| 26b | 0.021 | 0.053 | 0.074 |
| 27a | 0.043 | 0.07 | 0.091 |
| 27b | 0.04 | 0.074 | 0.089 |

TABLE 8C-continued

| Sample | 5 Day 131° F., 90% RH ΔDmin | 7 Day 131° F., 90% RH ΔDmin | 9 Day 131° F., 90% RH ΔDmin |
|---|---|---|---|
| 28a | 0.042 | 0.073 | 0.084 |
| 28b | 0.035 | 0.068 | 0.086 |
| 29a | 0.02 | 0.08 | 0.177 |
| 29b | 0.02 | 0.078 | 0.146 |
| 30a | 0.022 | 0.072 | 0.152 |
| 30b | 0.023 | 0.078 | 0.146 |
| 31a | 0.02 | 0.088 | 0.177 |
| 31b | 0.019 | 0.085 | 0.156 |

Example 3

Samples of photothermographic materials were prepared and analyzed according to the preparations discussed in the methods section, except that samples contained different crosslinkers and crosslinker weights. The type and weight of crosslinker in Solution B was varied, as shown in Table 9. The amount of crosslinker was varied based on the standard usage of DESMODUR® N 3300 A, at a OH:NCO ratio of equivalent weight of 141. All samples had a 50% by weight B03TX and 50% by weight B45H. All other steps remain the same. Table 9 shows the properties of the PVB resins and other process variables for preparing the photothermographic materials. Tables 10, 11, and 12 show silver efficiencies, print stabilities, and accelerated aging, respectively, for the samples.

These results demonstrate that: 1) the type of THDI crosslinker did not appear to affect silver efficiency, print stability, accelerated aging, or initial sensitometry measurements Dmin, Dmax, speed-2, speed-3, and AC-1, and 2) there is an inverse relationship between crosslinker weight and initial sensitometry measurements (there is a proportional relationship between OH:NCO and initial sensitometry measurements), 3) there is a proportional relationship between crosslinker weight and ΔDmin 7-day and 9-day accelerated aging tests (there is an inverse relationship between crosslinker weight and ΔDmin 7-day and 9-day accelerated aging tests), and 4) there is improvement in ΔDmin light chamber print stability.

The invention has been described in detail with reference to specific embodiments, but it will be understood that variations and modifications can be effected within the spirit and scope of the invention. The presently disclosed embodiments are therefore considered in all respects to be illustrative and not restrictive. The scope of the invention is indicated by the claims that will issue from applications claiming benefit of this provisional application, and all changes that come within the meaning and range of equivalents thereof are intended to be embraced therein.

TABLE 9

| Sample | Crosslinker | Type | Crosslinker in Top Coat relative to Standard | NCO Equivalent Weight | OH:NCO Ratio of Equivalent Weight |
|---|---|---|---|---|---|
| 1a | Desmodur N 3200 | HDI biuret | 1 | 183 | 141 |
| 1b | Desmodur N 3200 | HDI biuret | 1 | 183 | 141 |
| 2a | Desmodur N 3200 | HDI biuret | 2 | 183 | 71 |
| 2b | Desmodur N 3200 | HDI biuret | 2 | 183 | 71 |
| 3a | Desmodur N 3600 | HDI Poly-NCO | 1 | 183 | 141 |
| 3b | Desmodur N 3600 | HDI Poly-NCO | 1 | 183 | 141 |
| 4a | Desmodur N 3600 | HDI Poly-NCO | 2 | 183 | 71 |
| 4b | Desmodur N 3600 | HDI Poly-NCO | 2 | 183 | 71 |
| 5a | Desmodur N 3800 | HDI trimer | 1 | 382 | 141 |
| 5b | Desmodur N 3800 | HDI trimer | 1 | 382 | 141 |
| 6a | Desmodur N 3800 | HDI trimer | 2 | 382 | 71 |
| 6b | Desmodur N 3800 | HDI trimer | 2 | 382 | 71 |
| 7a | Desmodur XP 2838 | HDI + IPDI | 1 | 210 | 141 |
| 7b | Desmodur XP 2838 | HDI + IPDI | 1 | 210 | 141 |
| 8a | Desmodur XP 2838 | HDI + IPDI | 2 | 210 | 71 |
| 8b | Desmodur XP 2838 | HDI + IPDI | 2 | 210 | 71 |
| 9a | Desmodur N 3300A | HDI trimer | 1 | 193 | 141 |
| 9b | Desmodur N 3300A | HDI trimer | 1 | 193 | 141 |
| 10a | Desmodur N 3200 | HDI biuret | 0.5 | 183 | 282 |
| 10b | Desmodur N 3200 | HDI biuret | 0.5 | 183 | 282 |
| 11a | Desmodur N 3200 | HDI biuret | 3.0 | 183 | 47 |
| 11b | Desmodur N 3200 | HDI biuret | 3.0 | 183 | 47 |
| 12a | Desmodur N 3600 | HDI Poly-NCO | 0.5 | 183 | 282 |
| 12b | Desmodur N 3600 | HDI Poly-NCO | 0.5 | 183 | 282 |
| 13a | Desmodur N 3600 | HDI Poly-NCO | 3.0 | 183 | 47 |
| 13b | Desmodur N 3600 | HDI Poly-NCO | 3.0 | 183 | 47 |
| 14a | Desmodur N 3800 | HDI trimer | 0.5 | 382 | 282 |
| 14b | Desmodur N 3800 | HDI trimer | 0.5 | 382 | 282 |
| 15a | Desmodur N 3800 | HDI trimer | 3.0 | 382 | 47 |
| 15b | Desmodur N 3800 | HDI trimer | 3.0 | 382 | 47 |
| 16a | Desmodur XP 2838 | HDI + IPDI | 0.5 | 210 | 282 |
| 16b | Desmodur XP 2838 | HDI + IPDI | 0.5 | 210 | 282 |
| 17a | Desmodur XP 2838 | HDI + IPDI | 3.0 | 210 | 47 |
| 17b | Desmodur XP 2838 | HDI + IPDI | 3.0 | 210 | 47 |
| 18a | Desmodur N 3300A | HDI trimer | 1.0 | 193 | 141 |
| 18b | Desmodur N 3300A | HDI trimer | 1.0 | 193 | 141 |

TABLE 10

| Sample ID | Silver Coating Weight g/m$^2$ | Silver Efficiency m$^2$/g | Dmin | Dmax | Speed-2 | Speed-3 | AC-1 |
|---|---|---|---|---|---|---|---|
| 1a | 1.79 | 2.19 | 0.201 | 3.92 | 1.81 | 1.37 | 4.60 |
| 1b | 1.79 | 2.12 | 0.204 | 3.80 | 1.75 | 1.24 | 3.93 |
| 2a | 1.81 | 2.09 | 0.201 | 3.78 | 1.69 | 1.18 | 3.77 |
| 2b | 1.78 | 2.11 | 0.202 | 3.76 | 1.68 | 1.17 | 3.70 |
| 3a | 1.80 | 2.16 | 0.204 | 3.88 | 1.80 | 1.30 | 4.03 |
| 3b | 1.73 | 2.18 | 0.204 | 3.78 | 1.78 | 1.26 | 4.02 |
| 4a | 1.75 | 2.11 | 0.202 | 3.69 | 1.74 | 1.22 | 4.00 |
| 4b | 1.68 | 2.13 | 0.203 | 3.58 | 1.70 | 1.14 | 3.58 |
| 5a | 1.80 | 2.15 | 0.204 | 3.86 | 1.79 | 1.31 | 4.01 |
| 5b | 1.70 | 2.13 | 0.204 | 3.63 | 1.77 | 1.22 | 3.82 |
| 6a | 1.75 | 2.12 | 0.203 | 3.71 | 1.72 | 1.17 | 3.65 |
| 6b | 1.69 | 2.14 | 0.203 | 3.62 | 1.69 | 1.10 | 3.46 |
| 7a | 1.90 | 2.14 | 0.205 | 4.06 | 1.80 | 1.35 | 4.46 |
| 7b | 1.86 | 2.11 | 0.206 | 3.92 | 1.79 | 1.34 | 4.34 |
| 8a | 1.70 | 2.12 | 0.202 | 3.61 | 1.70 | 1.13 | 3.64 |
| 8b | 1.60 | 2.17 | 0.201 | 3.47 | 1.72 | 1.10 | 3.49 |
| 9a | 1.76 | 2.16 | 0.203 | 3.80 | 1.78 | 1.27 | 4.03 |
| 9b | 1.67 | 2.15 | 0.204 | 3.59 | 1.74 | 1.18 | 3.69 |
| 10a | 1.75 | 2.15 | 0.207 | 3.76 | 1.80 | 1.28 | 3.87 |
| 10b | 1.79 | 2.18 | 0.206 | 3.90 | 1.77 | 1.26 | 4.01 |
| 11a | 1.88 | 2.10 | 0.202 | 3.95 | 1.70 | 1.24 | 3.94 |
| 11b | 1.70 | 2.04 | 0.200 | 3.47 | 1.62 | 1.01 | 3.27 |
| 12a | 1.83 | 2.15 | 0.207 | 3.94 | 1.80 | 1.30 | 4.00 |
| 12b | 1.75 | 2.15 | 0.207 | 3.76 | 1.78 | 1.26 | 3.88 |
| 13a | 1.72 | 2.09 | 0.202 | 3.59 | 1.70 | 1.12 | 3.47 |
| 13b | 1.75 | 2.08 | 0.202 | 3.64 | 1.69 | 1.15 | 3.66 |
| 14a | 1.77 | 2.15 | 0.208 | 3.81 | 1.80 | 1.29 | 4.04 |
| 14b | 1.73 | 2.13 | 0.208 | 3.68 | 1.78 | 1.25 | 3.91 |
| 15a | 1.74 | 2.07 | 0.201 | 3.61 | 1.70 | 1.15 | 3.61 |
| 15b | 1.73 | 2.03 | 0.204 | 3.50 | 1.65 | 1.05 | 3.32 |
| 16a | 1.76 | 2.15 | 0.207 | 3.79 | 1.78 | 1.26 | 3.82 |
| 16b | 1.80 | 2.14 | 0.207 | 3.86 | 1.79 | 1.29 | 4.03 |
| 17a | 1.75 | 2.09 | 0.202 | 3.66 | 1.69 | 1.15 | 3.55 |
| 17b | 1.66 | 2.10 | 0.202 | 3.49 | 1.71 | 1.08 | 3.37 |
| 18a | 1.71 | 2.12 | 0.205 | 3.62 | 1.77 | 1.21 | 3.77 |
| 18b | 1.69 | 2.14 | 0.204 | 3.62 | 1.75 | 1.20 | 3.81 |

TABLE 11

| | Hot-Dark 3 hr. in dark at 160° F. | | | Light Chamber 20 hrs. in light chamber at 120° F. | |
|---|---|---|---|---|---|
| Sample ID | $\Delta Dmin_B$ | $\Delta D$ at 1.2 IOD | $\Delta Dens_B$ (max) | $\Delta Dmin_B$ | $\Delta Dmin_V$ |
| 1a | 0.028 | 0.268 | 0.30 | 0.06 | 0.06 |
| 1b | 0.026 | 0.229 | 0.25 | 0.06 | 0.05 |
| 2a | 0.023 | 0.238 | 0.28 | 0.06 | 0.05 |
| 2b | 0.024 | 0.245 | 0.28 | 0.05 | 0.05 |
| 3a | 0.030 | 0.231 | 0.25 | 0.07 | 0.05 |
| 3b | 0.027 | 0.256 | 0.27 | 0.06 | 0.05 |
| 4a | 0.028 | 0.265 | 0.28 | 0.05 | 0.05 |
| 4b | 0.025 | 0.213 | 0.24 | 0.05 | 0.05 |
| 5a | 0.037 | 0.287 | 0.30 | 0.09 | 0.07 |
| 5b | 0.031 | 0.270 | 0.28 | 0.07 | 0.06 |
| 6a | 0.032 | 0.288 | 0.31 | 0.08 | 0.06 |
| 6b | 0.032 | 0.255 | 0.27 | 0.07 | 0.05 |
| 7a | 0.037 | 0.263 | 0.30 | 0.08 | 0.06 |
| 7b | 0.033 | 0.259 | 0.28 | 0.07 | 0.05 |
| 8a | 0.025 | 0.229 | 0.25 | 0.05 | 0.05 |
| 8b | 0.025 | 0.235 | 0.26 | 0.05 | 0.04 |
| 9a | 0.028 | 0.244 | 0.26 | 0.06 | 0.05 |
| 9b | 0.025 | 0.199 | 0.22 | 0.05 | 0.04 |
| 10a | 0.030 | 0.201 | 0.22 | 0.08 | 0.06 |
| 10b | 0.028 | 0.194 | 0.22 | 0.09 | 0.06 |
| 11a | 0.027 | 0.242 | 0.35 | 0.06 | 0.05 |
| 11b | 0.024 | 0.247 | 0.35 | 0.06 | 0.04 |
| 12a | 0.035 | 0.208 | 0.23 | 0.09 | 0.07 |
| 12b | 0.031 | 0.179 | 0.21 | 0.07 | 0.06 |
| 13a | 0.026 | 0.257 | 0.28 | 0.06 | 0.05 |
| 13b | 0.025 | 0.270 | 0.32 | 0.06 | 0.05 |

TABLE 11-continued

| | Hot-Dark 3 hr. in dark at 160° F. | | | Light Chamber 20 hrs. in light chamber at 120° F. | |
|---|---|---|---|---|---|
| Sample ID | $\Delta Dmin_B$ | $\Delta D$ at 1.2 IOD | $\Delta Dens_B$ (max) | $\Delta Dmin_B$ | $\Delta Dmin_V$ |
| 14a | 0.038 | 0.273 | 0.29 | 0.10 | 0.08 |
| 14b | 0.037 | 0.225 | 0.25 | 0.09 | 0.07 |
| 15a | 0.034 | 0.294 | 0.34 | 0.08 | 0.07 |
| 15b | 0.036 | 0.317 | 0.37 | 0.08 | 0.06 |
| 16a | 0.033 | 0.222 | 0.24 | 0.08 | 0.06 |
| 16b | 0.035 | 0.265 | 0.29 | 0.08 | 0.06 |
| 17a | 0.027 | 0.260 | 0.32 | 0.06 | 0.04 |
| 17b | 0.027 | 0.237 | 0.27 | 0.05 | 0.04 |
| 18a | 0.026 | 0.180 | 0.20 | 0.06 | 0.05 |
| 18b | 0.027 | 0.196 | 0.22 | 0.06 | 0.05 |

TABLE 12

| Sample | 7 Day 131° F., 90% RH ΔDmin | 9 Day 131° F., 90% RH ΔDmin |
|---|---|---|
| 1a | 0.046 | 0.109 |
| 1b | 0.047 | 0.145 |
| 2a | 0.053 | 0.161 |
| 2b | 0.058 | 0.175 |
| 3a | 0.040 | 0.115 |
| 3b | 0.039 | 0.114 |
| 4a | 0.047 | 0.132 |
| 4b | 0.046 | 0.141 |
| 5a | 0.050 | 0.142 |
| 5b | 0.053 | 0.171 |
| 6a | 0.056 | 0.202 |
| 6b | 0.063 | 0.225 |
| 7a | 0.037 | 0.113 |
| 7b | 0.041 | 0.124 |
| 8a | 0.048 | 0.140 |
| 8b | 0.046 | 0.151 |
| 9a | 0.032 | 0.117 |
| 9b | 0.039 | 0.117 |
| 10a | 0.125 | 0.333 |
| 10b | 0.127 | 0.332 |
| 11a | 0.192 | 0.386 |
| 11b | 0.208 | 0.419 |
| 12a | 0.107 | 0.305 |
| 12b | 0.106 | 0.327 |
| 13a | 0.159 | 0.502 |
| 13b | 0.163 | 0.391 |
| 14a | 0.107 | 0.316 |
| 14b | 0.118 | 0.366 |
| 15a | 0.226 | 0.828 |
| 15b | 0.287 | 0.837 |
| 16a | 0.110 | 0.340 |
| 16b | 0.119 | 0.324 |
| 17a | 0.179 | 0.409 |
| 17b | 0.183 | 0.436 |
| 18a | 0.113 | 0.395 |
| 18b | 0.111 | 0.331 |

What is claimed:

1. A thermally developable material comprising a support and having thereon at least one thermally developable imaging layer comprising in reactive association:

at least one non-photosensitive source of reducible silver ions, at least one reducing agent for said reducible ions, at least one binder compound comprising vinyl butyral repeat units and vinyl alcohol repeat units, and at least one crosslinker compound comprising an isocyanate group, wherein a first total mass of vinyl alcohol repeat units in the at least one binder compound and a second total mass of the at least one crosslinker compound are present in the at least one thermally developable imaging layer, and further wherein the ratio of the first total mass to the second total mass is at least 75.

2. The material of claim 1, wherein the ratio of the first total mass to the second total mass is between about 140 and about 300.

3. The material of claim 1, wherein the thermally developable material is a photothermographic material and further comprises a photosensitive silver halide.

4. The material of claim 1, wherein the at least one crosslinker compound comprises isocyanate repeat units.

5. The material of claim 1, wherein the at least one crosslinker compound comprises hexamethylene diisocyanate.

6. The material of claim 1, wherein the at least one crosslinker compound comprises 1,6-hexamethylene diisocyanate.

7. The material of claim 1, wherein the at least one crosslinker compound comprises a trimer of hexamethylene diisocyanate.

8. The material of claim 1, wherein the at least one binder compound comprises poly(vinyl butyral).

* * * * *